US006830305B1

(12) United States Patent
Takizawa

(10) Patent No.: US 6,830,305 B1
(45) Date of Patent: Dec. 14, 2004

(54) INK JET RECORDING HEAD DRIVING METHOD AND CIRCUIT THEREFOR

(75) Inventor: Fuminori Takizawa, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/889,653

(22) PCT Filed: Jan. 14, 2000

(86) PCT No.: PCT/JP00/00150

§ 371 (c)(1),
(2), (4) Date: Jul. 19, 2001

(87) PCT Pub. No.: WO00/43210

PCT Pub. Date: Jul. 27, 2000

(30) Foreign Application Priority Data

Jan. 25, 1999 (JP) ..... 11/016235

(51) Int. Cl.[7] ..... B41J 29/38
(52) U.S. Cl. ..... 347/10; 347/11; 347/15
(58) Field of Search ..... 347/10, 15, 41, 347/14, 11

(56) References Cited

U.S. PATENT DOCUMENTS

| | | | | |
|---|---|---|---|---|
| 6,145,949 A | * | 11/2000 | Takahashi | 347/14 |
| 6,276,773 B1 | * | 8/2001 | Takizawa | 347/10 |
| 6,283,568 B1 | * | 9/2001 | Horii et al. | 347/10 |
| 6,293,643 B1 | * | 9/2001 | Shimada et al. | 347/15 |

FOREIGN PATENT DOCUMENTS

| | | |
|---|---|---|
| EP | 917955 | 5/1999 |
| JP | 9-11457 | 1/1997 |
| JP | 10-157113 | 6/1998 |
| JP | 10-244691 | 9/1998 |
| JP | 10-250068 | 9/1998 |
| JP | 11-207947 | 8/1999 |
| JP | 11-254662 | 9/1999 |
| JP | 2000-168059 | 6/2000 |

* cited by examiner

*Primary Examiner*—Hai Pham
*Assistant Examiner*—Lam Nguyen
(74) *Attorney, Agent, or Firm*—Dickstein, Shaprio, Morin & Oshinsky, LLP.

(57) ABSTRACT

A high-quality gray scale printing is attained by using an ink jet recording head having a simple and low-cost configuration and a general-purpose structure, and ink having common components.

An ink jet recording head driving method to be disclosed comprises repeating a plurality of times a dot forming process for forming a plurality of dots on a recording medium, while an ink jet recording head is moved in a sub-scanning direction; the process comprising the steps of moving the ink jet recording head in a main scanning direction, generating a plurality of drive waveform signals according to a jet amount of ink droplets, selecting any one or none of the plurality of waveform signals for each of a plurality of nozzles according to gray scale information of printing data, and applying voltage to corresponding piezolectric actuators.

20 Claims, 16 Drawing Sheets

(1) D1

(2) D2

(3) D3

(1) D4

(2) D5

(3) D6

| | 1 | 2 | 3 | 4 | 5 | 6 |
|---|---|---|---|---|---|---|
| 1 | 2 | 3 | 4 | 5 | 6 | 5 |
| 2 | 3 | 4 | 5 | 6 | 5 | 4 |
| 3 | 4 | 5 | 6 | 5 | 4 | 3 |
| 4 | 5 | 6 | 5 | 4 | 3 | 2 |
| 5 | 6 | 5 | 4 | 3 | 2 | 1 |
| 6 | 5 | 4 | 3 | 2 | 1 | |

FIG. 9

(1)

| | | | | | | |
|---|---|---|---|---|---|---|
| | | | | | | |
| | | | | | | |
| | | | | | | |
| | | | | | | |
| | | | | | | |
| 5 | | 5 | | 3 | | 1 |
| | 5 | | 3 | | 1 | |

(2)

| | | | | | | |
|---|---|---|---|---|---|---|
| | | | | | | |
| | | | | | | |
| | | | | | | |
| | 4 | | 6 | | 4 | |
| 4 | | 6 | | 4 | | 2 |
| 5 | 6 | 5 | 4 | 3 | 2 | 1 |
| 6 | 5 | 4 | 3 | 2 | 1 | |

(3)

| | | | | | | |
|---|---|---|---|---|---|---|
| | | | | | | |
| 1 | | 3 | | 5 | | 5 |
| | 3 | | 5 | | 5 | |
| 3 | 4 | 5 | 6 | 5 | 4 | 3 |
| 4 | 5 | 6 | 5 | 4 | 3 | 2 |
| 5 | 6 | 5 | 4 | 3 | 2 | 1 |
| 6 | 5 | 4 | 3 | 2 | 1 | |

FIG. 10

(1)

| | | | | | | |
|---|---|---|---|---|---|---|
| | | 2 | | 4 | | 6 |
| 1 | 2 | 3 | 4 | 5 | 6 | 5 |
| 2 | 3 | 4 | 5 | 6 | 5 | 4 |
| 3 | 4 | 5 | 6 | 5 | 4 | 3 |
| 4 | 5 | 6 | 5 | 4 | 3 | 2 |
| 5 | 6 | 5 | 4 | 3 | 2 | 1 |
| 6 | 5 | 4 | 3 | 2 | 1 | |

(2)

| | 1 | 2 | 3 | 4 | 5 | 6 |
|---|---|---|---|---|---|---|
| 1 | 2 | 3 | 4 | 5 | 6 | 5 |
| 2 | 3 | 4 | 5 | 6 | 5 | 4 |
| 3 | 4 | 5 | 6 | 5 | 4 | 3 |
| 4 | 5 | 6 | 5 | 4 | 3 | 2 |
| 5 | 6 | 5 | 4 | 3 | 2 | 1 |
| 6 | 5 | 4 | 3 | 2 | 1 | |

FIG. 11

(1)

| | | | | | | |
|---|---|---|---|---|---|---|
| | | | | | | |
| | | | | | | |
| | | | | | | |
| | | | | | | |
| | | | | | | |
| | | | | 3 | 2 | 1 |
| | | | 3 | 2 | 1 | |

(2)

| | | | | | | |
|---|---|---|---|---|---|---|
| | | | | | | |
| | | | | | | |
| | | | | | | |
| | 4 | 5 | 6 | 5 | 4 | |
| 4 | 5 | 6 | 5 | 4 | | |
| 5 | 6 | 5 | 4 | 3 | 2 | 1 |
| 6 | 5 | 4 | 3 | 2 | 1 | |

(3)

| | | | | | | |
|---|---|---|---|---|---|---|
| | | | | | | |
| 1 | 2 | 3 | | | | |
| 2 | 3 | | | | | |
| 3 | 4 | 5 | 6 | 5 | 4 | 3 |
| 4 | 5 | 6 | 5 | 4 | 3 | 2 |
| 5 | 6 | 5 | 4 | 3 | 2 | 1 |
| 6 | 5 | 4 | 3 | 2 | 1 | |

(1)

| | | | | | | |
|---|---|---|---|---|---|---|
| | | | | 4 | 5 | 6 |
| 1 | 2 | 3 | 4 | 5 | 6 | 5 |
| 2 | 3 | 4 | 5 | 6 | 5 | 4 |
| 3 | 4 | 5 | 6 | 5 | 4 | 3 |
| 4 | 5 | 6 | 5 | 4 | 3 | 2 |
| 5 | 6 | 5 | 4 | 3 | 2 | 1 |
| 6 | 5 | 4 | 3 | 2 | 1 | |

(2)

| | | | | | | |
|---|---|---|---|---|---|---|
| | 1 | 2 | 3 | 4 | 5 | 6 |
| 1 | 2 | 3 | 4 | 5 | 6 | 5 |
| 2 | 3 | 4 | 5 | 6 | 5 | 4 |
| 3 | 4 | 5 | 6 | 5 | 4 | 3 |
| 4 | 5 | 6 | 5 | 4 | 3 | 2 |
| 5 | 6 | 5 | 4 | 3 | 2 | 1 |
| 6 | 5 | 4 | 3 | 2 | 1 | |

FIG. 14

(1)

| | | | | | | |
|---|---|---|---|---|---|---|
| | | | | | | |
| | | | | | | |
| | | | | | | |
| 3 | | 5 | | 5 | | 3 |
| | 5 | | 5 | | 3 | |
| 5 | | 5 | | 3 | | 1 |
| | 5 | | 3 | | 1 | |

(2)

| | | | | | | |
|---|---|---|---|---|---|---|
| | | | | | | |
| | | | | | | |
| | | | | | | |
| 3 | 4 | 5 | 6 | 5 | 4 | 3 |
| 4 | 5 | 6 | 5 | 4 | 3 | 2 |
| 5 | 6 | 5 | 4 | 3 | 2 | 1 |
| 6 | 5 | 4 | 3 | 2 | 1 | |

FIG. 15

(1)

| | | | | | | |
|---|---|---|---|---|---|---|
| | 1 | | 3 | | 5 | |
| 1 | | 3 | | 5 | | 5 |
| | 3 | | 5 | | 5 | |
| 3 | 4 | 5 | 6 | 5 | 4 | 3 |
| 4 | 5 | 6 | 5 | 4 | 3 | 2 |
| 5 | 6 | 5 | 4 | 3 | 2 | 1 |
| 6 | 5 | 4 | 3 | 2 | 1 | |

(2)

| | | | | | | |
|---|---|---|---|---|---|---|
| | 1 | 2 | 3 | 4 | 5 | 6 |
| 1 | 2 | 3 | 4 | 5 | 6 | 5 |
| 2 | 3 | 4 | 5 | 6 | 5 | 4 |
| 3 | 4 | 5 | 6 | 5 | 4 | 3 |
| 4 | 5 | 6 | 5 | 4 | 3 | 2 |
| 5 | 6 | 5 | 4 | 3 | 2 | 1 |
| 6 | 5 | 4 | 3 | 2 | 1 | |

INK JET RECORDING HEAD DRIVING METHOD AND CIRCUIT THEREFOR

TECHNICAL FIELD

The present invention relates to an ink jet recording head driving method and a circuit therefor which drives an ink jet recording head incorporating a piezoelectric actuator. More particularly, the present invention relates to an ink jet recording head driving method and a circuit therefor, capable of enhancing the gray scale quality of characters and picture images by changing a diameter of micro ink droplets, which are discharged from nozzles, by use of gray scale information of printing data, and thus changing a size of dots formed on a recording medium such as paper and OHP (overhead projector) film.

BACKGROUND ART

An ink jet printer is provided with a plurality of nozzles and records characters and image pictures on a recording medium such as paper or OHP film by selectively discharging equal-sized micro ink droplets, which are fitted to a recording resolution, from each of the nozzles. Particularly, a drop on demand type ink jet printer, which records characters and image pictures by discharging only the ink droplets necessitated for recording characters and image pictures from nozzles, has been extensively used at home and offices since it is easily miniaturized and colorized as well as generates little noise. In order to attain higher-quality characters and image pictures by use of the aforementioned ink jet printer, a gray scale printing is effective, which changes the size of dots formed on a recording medium by modulating a diameter of micro ink droplets discharged from nozzles according to gray scale information of printing data.

FIG. 16 is a block diagram showing an example of electric configuration of an ink jet recording head driving circuit applied to the aforementioned conventional ink jet printer (hereafter, referred to as "first prior art"). FIG. 17 is a sectional view showing an example of mechanical configuration of relevant part of an ink jet recording head 1. FIG. 18 is a plan view showing an example of mechanical configuration of relevant part of an ink jet printer.

The ink jet recording head 1 of the example has a laminated structure comprising a nozzle plate 3 provided with a plurality of nozzles 2 (orifices), a pressure generating chamber plate 5 which is provided concavely with a plurality of pressure generating chambers 4, 4, . . . having one-to-one correspondence to each of the nozzles 2 and filled with ink supplied from an ink tank (not shown) through both an ink pool (not shown) and an ink outlet 5*a*, a plurality of diaphragms 6, 6, . . . having one-to-one correspondence to the pressure generating chambers 4 and forming a bottom plate for each of the pressure generating chambers 4 and a plurality of piezoelectric actuators 7, 7, . . . attached to each of the diaphragms 6 respectively. Electrodes 8 and 9 are mounted at both edges of each of the piezoelectric actuators 7. One of the electrodes 8 and 9 is earthed through an electrode line 10 and the other is connected to a switching unit 24 shown in FIG. 16 through the electrode line 10. This ink jet recording head is a drop on demand type multi head and, in particular, referred to as a Kyser type within the head. According to such an ink jet recording head, when drive waveform signals are applied from the switching unit 24 to arbitrarily combined piezoelectric actuators 7, 7, . . . according to printing data, the piezoelectric actuators 7, 7, . . . displace the corresponding diaphragms 6. Accordingly, the volume of the pressure generating chamber 4 therein ink is filled is rapidly changed and thus an ink droplet 11 is discharged from the corresponding nozzle 2.

As shown in FIG. 18, according to the ink jet printer of the aforementioned example, the ink jet recording head 1 is mounted on a head guide axis 12 so that it is sidable in the right and left direction in the figure, and is driven by a head drive motor (not shown). Meanwhile, a recording medium 13 such as paper or OHP film is moved in the up and down direction in the figure by a feed roller 14 driven by a feed motor (not shown). Hereafter, moving direction of the ink jet recording head 1 is referred to as a main scanning direction, and that of a recording medium 13 as a sub-scanning direction.

An ink jet recording head driving circuit shown in FIG. 16 is schematically configured comprising a control unit 21, a drive waveform storage means 22, a waveform generating unit 23 and a switching unit 24. The control unit 21, according to commands supplied from outside, controls a head drive motor which drives the ink jet recording head 1 and a feed motor which drives a feed roller 14. At the same time, the control unit 21 supplies a nozzle selecting data DSN to the switching unit 24 at every discharging period which denotes an adequate period when the ink drop 11 should be discharged from each the nozzle 2. A nozzle selecting data indicates an appropriate piezoelectric actuator 7 out of a plurality of piezoelectric actuators 7, 7, . . . whereto drive waveform signals comprising waveform shown in FIG. 19 should be applied. Incidentally, at the adequate timing, the control unit 21 supplies a discharging start command which denotes a command to start discharging the ink droplet 11 from each nozzle 2 to the waveform generating unit 23. The drive waveform storage means 22 is, for example, composed of ROM and the like and stores drive waveform information on drive waveform signals which should be applied to a plurality of piezoelectric actuators 7, 7, . . . .

The waveform generating unit 23 comprises waveform generating circuits 25, power amplifying circuits (not shown) and the like. After the waveform generating circuit 25 generates drive waveform signals on the basis of drive waveform information which is read out from a drive waveform storage means 22, the power amplifying circuit amplifies power, and then the amplified drive waveform signals are supplied to the switching unit 24 on the basis of a discharging start command sent from the control unit 21. The switching unit 24 comprises such as nozzle selecting circuits 26 and switches 27, 27, . . . composed of transfer gates, for example, and provided to be corresponding to piezoelectric actuators 7, 7, . . . . On the basis of the nozzle selecting data DSN supplied from the control unit 21, the switching unit 24 turns on any one of the switches 27, and applies drive waveform signals supplied from the waveform generating unit 23 to the corresponding piezoelectric actuators 7.

In the ink jet printer with the aforementioned configuration, the control unit 21 controls a head drive motor which drives the ink jet recording head 1 and a feed motor which drives a feed roller 14 according to commands provided from outside. At the same time, the control unit 21 supplies a nozzle selecting data DSN to the switching unit 24 at every discharging period and supplies a discharging start command to the waveform generating unit 23.

Accordingly, the ink jet recording head 1 is moved in the main scanning direction, while the recording medium 13 is moved in the sub-scanning direction. After the waveform generating circuit 25 generates drive waveform signals on the basis of drive waveform information read out from the drive waveform storage means 22, a power amplifying circuit amplifies power signals. Thus, the amplified drive waveform signals are supplied to the switching unit 24 on the basis of a discharging start command sent from the control unit 21. The nozzle selecting circuit 26 turns on any one of the switches 27 on the basis of the nozzle selecting data DSN supplied from the control unit 21. In this way, drive waveform signals supplied from the waveform generating unit 23 are applied to the piezoelectric actuators 7.

As a result, the ink droplet 11 is discharged from the nozzle 2 corresponding to a piezoelectric actuator 7 whereto drive waveform signals are applied. As shown in FIG. 20, in the recording medium 13, a dot which is slightly larger than one pixel of recording resolution (the area surrounded by four lines) is formed.

Repeating the aforementioned operations, many dots are to be formed on the recording medium 13, and thus characters or picture images are recorded. In this case, the nozzle 2 goes through an arbitrary pixel position on the recording medium 13 only once. Hereafter, the phenomenon that the nozzle 2 goes through an arbitrary pixel position on the recording medium 13 is simply referred to as "scan(ning)".

According to the art disclosed in the Japanese Patent Application Laid-Open Nos. HEI 4-118245 and HEI 9-174884, one dot is formed by spotting a plurality of micro ink droplets, whereof sizes are standard or smaller in comparison with recording resolution, on one and the same place or around the place on a recording medium, and thus gray scale of picture images is expressed in accordance with the number of spotted ink droplets (hereafter, referred to as "second prior art").

Further, according to the art disclosed in the Japanese Patent Application Laid-Open No. HEI 4-361055, which is provided with a plurality of nozzles having a variety of ink droplet volumes, one pixel is formed by re-spotting ink droplets having a variety of volumes on one and the same place by repeating scanning, and thus gray scale recording is executed (hereafter, referred to as "third prior art").

Still further, according to the art disclosed in the Japanese Patent Application Laid-Open No. HEI 9-164706, which is provided with a plurality of nozzle line groups having a variety of nozzle diameters, points with a variety of dot diameters are formed on one and the same place of a recording medium through one scanning by exclusively driving those nozzles that have different diameters out of a plurality of nozzle lines (hereafter, referred to as "fourth prior art").

Additionally, according to the art disclosed in the Japanese Patent Application Laid-Open No. HEI 10-81012, drive waveform signals outputted at every printing period are comprised of a first pulse which discharges ink droplets of medium dots, a second pulse which discharges ink droplets of small dots, a third pulse which discharges ink droplets of medium dots and a fourth pulse which gives micro-vibration to meniscus. By selecting one or some of the first to four pulses on the basis of gray scale value, dots having different diameters are formed on a recording medium, and thus gray scale printing is realized (hereafter, referred to as "fifth prior art").

Furthermore, the art disclosed in the Japanese Patent Application Laid-Open No. HEI 9-11457 comprises a common waveform generating means which generates four kinds of drive waveform signals corresponding to a total of four cases; the cases of forming dots with three sizes and the case of not discharging ink, a recording means which records multi-valued printing data by converting the data into one fixed output, a signal processing means which signal-processes output of a recording means by use of a fixed format, and a multiplexer which makes one of the four transfer gates into the conducting state by using control signals formed by level-converting output of signal processing means and applies one of the four kinds of drive waveform signals to a piezoelectric actuator, and thus gray scale printing is realized (hereafter, referred to as "sixth prior art").

Meanwhile, in order to realize gray scale printing by use of the ink jet recording head driving circuit of the aforementioned first prior art, an ink jet recording bead 1 had to change drive waveform signals and repeat scanning at the same pixel position only number of times necessitated for gray scale. Thus, it took extremely long time to execute recording.

Additionally, according to the aforementioned second prior art, in the same manner as first prior art, since it was necessary to repeat scanning at the same pixel position on a recording medium, it took extremely long time to execute recording. At the same time, since a large number of ink droplets are spotted on one pixel, especially in case of color recording, quality of recording image can be lowered by inviting cockring, widening of lines or bleeding (blur of ink).

Further, according to the aforementioned third and fourth prior arts, since the number of the necessitated nozzles corresponds to the gray scale number, the size of an ink jet recoding head can be enlarged. Additionally, since the same number of piezoelectric actuators and other parts as that of nozzles are necessitated, an ink jet recording printer can be high-cost owing to enlargement of the size and complication of the configuration.

Still further, according to the aforementioned fifth prior art, an ink jet recording head is driven so that a plurality of ink droplets having a variety of jet amounts are discharged from the same nozzle within an extremely short time of one printing period. However, in order to precisely discharge a plurality of ink droplets with a variety of jet amounts within a short time, a special-purpose structure can be necessitated for nozzles or pressure generating chambers which are incorporated in an ink jet recording head. Also, ink has to be developed so as to have special components capable of consecutively discharging ink droplets with a variety of sizes within a short time (e.g., flow resistance or surface tensile need to be devised). However, according the art disclosed in the Japanese Patent Application Laid-Open No. HEI 10-81012, there is no disclosure in reference to structure of nozzles or pressure generating chambers, or components of ink, but only to a generating means of drive waveform signals. For such a reason, the art disclosed in the Japanese Patent Application Laid-Open No. HEI 10-81012 has a problem of being unable to execute gray scale printing by forming dots with a variety of diameters on a recording medium.

Incidentally, according to the aforementioned sixth prior art, drive waveform signals corresponding to the gray scale number are outputted from a common waveform generating means on a steady basis. By selecting one of the drive waveform signals, making the corresponding transfer gate conductive and applying the drive waveform signal to a piezoelectric actuator, dots with a desirable size are to be formed on a recording medium through one scanning.

However, the larger the number of gray scale will be, the larger the number of drive waveform signals generated by a common waveform generating means will be. At the same time, structure of a multiplexer (the same number of transfer gates as gray scale number are necessary) for selecting one of a plurality of drive waveform signals becomes complicated accordingly. Consequently, an ink jet printer can be high-cost owing to enlargement of the size and complication of the configuration.

The present invention was developed in order to solve the aforementioned problems and shortcomings, and an object of the present invention is to provide an ink jet recording head driving method and a circuit therefor capable of realizing high-quality gray scale printing within a short time by using an ink jet recording head having a simple and low-cost configuration and a general-purpose structure, and ink having common components.

DISCLOSURE OF THE INVENTION

The present invention according to claim 1 relates to an ink jet recording head driving method provided with a plurality of nozzles and a plurality of pressure generating chambers corresponding thereto, and comprises the steps of applying drive waveform signals to piezoelectric actuators provided at the positions corresponding to the pressure generating chambers in case of recording, rapidly changing the volume of pressure generating chambers filled with ink, discharging ink droplets from the plurality of nozzles and forming dots on a recording medium. The present invention according to claim 1 is featured in repeating a dot forming process for forming a plurality of dots on the recording medium, and the process comprises the steps of moving the ink jet recording head is moved in a first direction which is relatively orthogonal to the located direction of the plurality of nozzles concerning the recording medium, generating a plurality of drive waveform signals according to a jet amount of the ink droplets, selecting any one or none of the plurality of waveform signals for each of the plurality of nozzles according to gray scale information of printing data, and applying voltage to corresponding piezoelectric actuators, while the ink jet recording head is moved in a second direction which is relatively orthogonal to the first direction concerning the recording medium.

The present invention according to claim 2 relates to an ink jet recording head driving method claimed in claim 1, and is featured in that at least one of a plurality of drive waveform signals generated at the aforementioned dot forming process is different from any of a plurality of drive waveform signals generated at the previously executed dot forming process.

The present invention according to claim 3 relates to an ink jet recording head driving method claimed in claim 1 or 2, and is featured in that at the aforementioned dot forming process, drive waveform signals for discharging ink droplets with a large jet amount and those with a small jet amount are generated in combination.

The present invention according to claim 4 relates to an ink jet recording head driving method claimed in claim 1 or 2, and is featured in that a dot forming process for generating drive waveform signals discharging ink droplets with a large jet amount and those with a small jet amount are alternately executed.

The present invention according to claim 5 relates to an ink jet recording head driving method claimed in one of the claims 1 to 4, and is featured in that the aforementioned dot forming process is executed at least twice on one and the same place of the aforementioned recording medium.

The present invention according to claim 6 relates to an ink jet recording head driving method claimed in claim 5, and is featured in that at the aforementioned dot forming process, nozzles which are positioned at the different place from the nozzles used at the previously executed dot forming process pass the place opposed to one and the same place of the aforementioned recording medium.

The present invention according to claim 7 relates to an ink jet recording head driving method claimed in claim 5, and is featured in that at the aforementioned dot forming process, nozzles which are positioned at the same place as the nozzles used at the previously executed dot forming process pass the place opposed to one and the same place of the aforementioned recording medium.

The present invention according to claim 8 relates to an ink jet recording head driving method claimed in claim 6 or 7, and is featured in that combination of drive waveform signals selected at once of the dot forming process is determined on the basis of not only the number of times of the aforementioned dot forming process but also the number of times whereof the same or different nozzles pass the place opposed to one and the same place of the aforementioned recording medium.

The present invention according to claim 9 relates to an ink jet recording head driving method claimed in claim 8, and is featured in that the number of times of the aforementioned dot forming process but also the number of times whereof the same or different nozzles pass the place opposed to one and the same place of the aforementioned recording medium are determined on the basis of a high-speed printing mode which is set up for printing in high-speed and a high-quality image mode which is set up for printing in high-quality image.

The present invention according to claim 10 relates to an ink jet recording head driving circuit provided with a plurality of nozzles and a plurality of pressure generating chambers corresponding thereto, and comprises the steps of applying drive waveform signals to piezoelectric actuators provided at the positions corresponding to the pressure generating chambers in case of recording, rapidly changing the volume of pressure generating chambers filled with ink, discharging ink droplets from the plurality of nozzles and forming dots on a recording medium. The present invention according to claim 10 is featured in that an ink jet recording head driving circuit comprises a recording means which records drive waveform drive waveform information signals at each jet amount of the aforementioned ink droplets, a waveform generating means which generates a plurality of drive waveform signals on the basis of information on a plurality of drive waveforms, which are read out from the recording means, a control means which moves the ink jet recording head in a first direction which is relatively orthogonal to the located direction of the plurality of nozzles concerning the recording medium, and outputs waveform selecting signals indicating that, on the basis of gray scale information of printing data, any one or none of the plurality of drive waveform signals should be selected for each of the plurality of nozzles, and a drive means which applies voltage to the piezoelectric actuators by selecting none or any one of a plurality of drive waveform signals outputted from the plurality of drive generating means on the basis of the waveform selecting data, while the control means moves the ink jet recording head in a second direction which is relatively orthogonal to the fist direction concerning the recording medium, and repeats not only scanning of the ink jet recording head in the first direction but also outputting the waveform selecting data.

The present invention according to claim 11 relates to an ink jet recording head driving circuit claimed in claim 10, and is featured in that the aforementioned waveform generating means generates at least one drive waveform signal which is different from any of a plurality of drive waveform signals generated at the previous scanning at every scanning of the aforementioned ink jet recording head in a first direction.

The present invention according to claim 12 relates to an ink jet recording head driving circuit claimed in claim 10 or 11, and is featured in that the aforementioned waveform generating means generates drive waveform signals for discharging ink droplets with a large jet amount and those with a small jet amount in combination.

The present invention according to claim 13 relates to an ink jet recording head driving circuit claimed in claim 10 or 11, and is featured in that the aforementioned waveform generating means alternately generates a plurality of drive waveform signals for discharging ink droplets with a relatively large jet amount and those with a relatively small jet amount.

The present invention according to claim 14 relates to an ink jet recording head driving circuit claimed in one of the claims 10 to 13, and is featured in that the aforementioned control means executes at least twice of not only scanning in the first direction of the ink jet recording head but outputting the waveform selecting data on one and the same place of the aforementioned recording medium.

The present invention according to claim 15 relates to an ink jet recording head driving circuit claimed in claim 14, and is featured in that the aforementioned control means makes nozzles, which are positioned at the different place from the nozzles used for scanning of the ink jet recording head in the first direction, pass the place opposed to one and the first place of the aforementioned recording medium.

The present invention according to claim 16 relates to an ink jet recording head driving circuit claimed in claim 14, and is featured in that the aforementioned control means makes nozzles, which are positioned at the same place as the nozzles used for scanning of the ink jet recording head in the first direction, pass the place opposed to one and the same place of the aforementioned recording medium.

The present invention according to claim 17 relates to an ink jet recording head driving circuit claimed in claim 15 or 16, and is featured in that the aforementioned control means generates the waveform selecting data on the basis of the data, supplied from outside, concerning combination of drive waveform signals selected at not only once of scanning of the ink jet recording head in the first direction but also outputting the waveform selecting data.

The present invention according to claim 18 relates to an ink jet recording head driving circuit claimed in claim 17, and is featured in that combination of the drive waveform signals is determined on the basis of not only the number of times of scanning of the ink jet recording head in the first direction but also the number of times whereof the same or different nozzles pass the place opposed to one and the same place of the aforementioned recording medium.

The present invention according to claim 19 relates to an ink jet recording head driving circuit claimed in claim 18, and is featured in that the number of times of scanning of the ink jet recording head in the first direction but also the number of times whereof the same or different nozzles pass the place opposed to one and the same place of the aforementioned recording medium are determined on the basis of a high-speed printing mode which is set up for printing in high-speed and a high-quality image mode which is set up for printing in high-quality image.

The present invention according to claim 20 relates to an ink jet recording head driving circuit claimed in claim 15 or 16, and is featured in that the aforementioned control means determines the number of times of scanning of the ink jet recording head in the first direction but also the number of times whereof the same or different nozzles pass the place opposed to one and the same place of the aforementioned recording medium on the basis of a high-speed printing mode which is set up for printing in high-speed and a high-quality image mode which is set up for printing in high-quality image, and determines the combination of drive waveform signals selected at not only once of scanning of the ink jet recording head in the first direction but also outputting the waveform selecting data on the basis of the determined number of times of scanning of the ink jet recording head in the first direction and number of times whereof the same or different nozzles pass the place opposed to one and the same place of the aforementioned recording medium, and generates the waveform selecting data on the basis of the determined combination of the drive waveform signals.

BRIEF DESCRIPTION OF THE DRAWINGS

FIG. 9 is a diagram for explaining an ink jet recording head driving method according to the first embodiment;

FIG. 10 is a diagram for explaining an ink jet recording head driving method according to the first embodiment;

FIG. 11 is a diagram for explaining an ink jet recording head driving method according to a second embodiment;

FIG. 14 is a diagram for explaining an ink jet recording head driving method according to the third embodiment;

FIG. 15 is a diagram for explaining an ink jet recording head driving method according to the third embodiment;

ACTION OF THE INVENTION

The present invention realizes high-quality gray scale printing within a short time by using an ink jet recording head having a simple and low-cost configuration and a general-purpose structure, and ink having common components.

BEST MODE FOR CARRYING OUT THE INVENTION

Embodiments of the present invention will be described with reference to the drawings. The following explanation will be given in detail showing practical examples.

A. First Embodiment

First of all, an explanation will be given on a first embodiment of the present invention.

Figure 1:
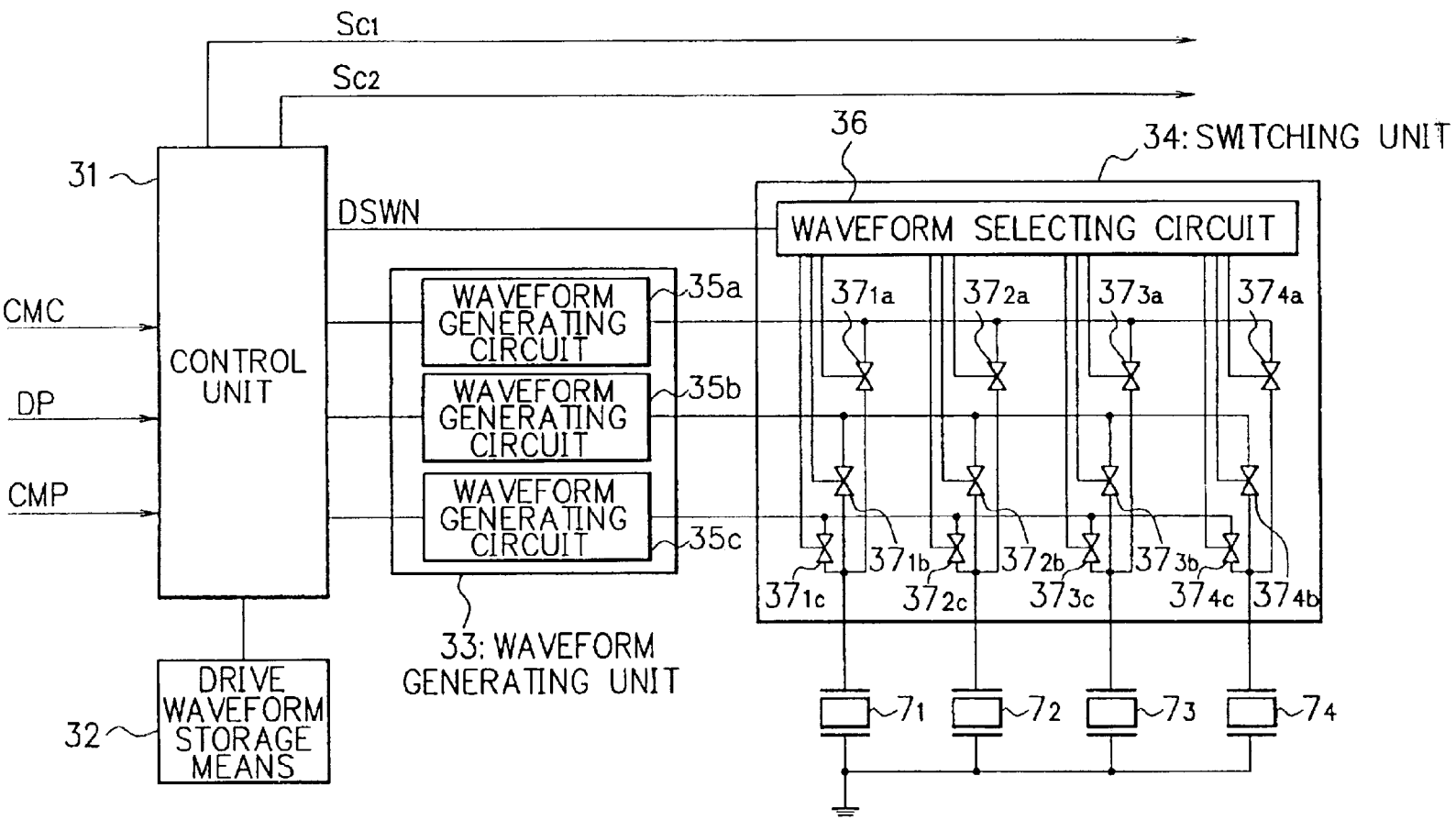
FIG. 1 is a block diagram schematically showing an electric configuration of an ink jet recording head driving circuit whereto an ink jet recording head driving method according to a first embodiment of the present invention is applied.
Figure 2:
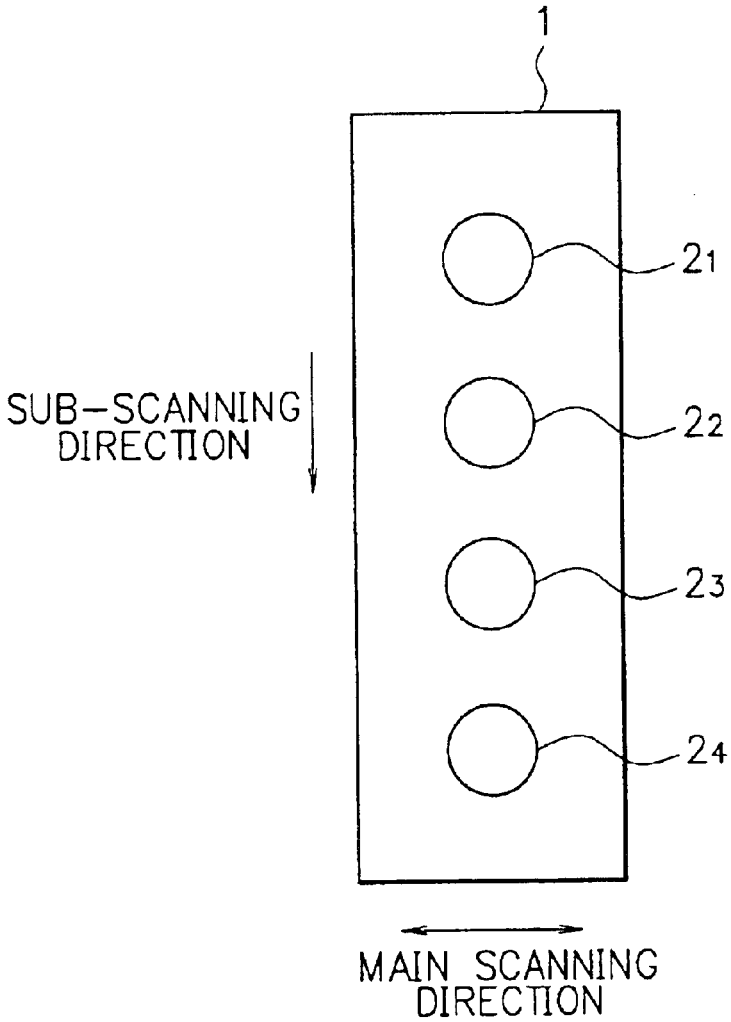
FIG. 2 is a back side view showing an example of a configuration of an ink jet recording head constructing an ink jet printer whereto the circuit is applied.
Figure 17:
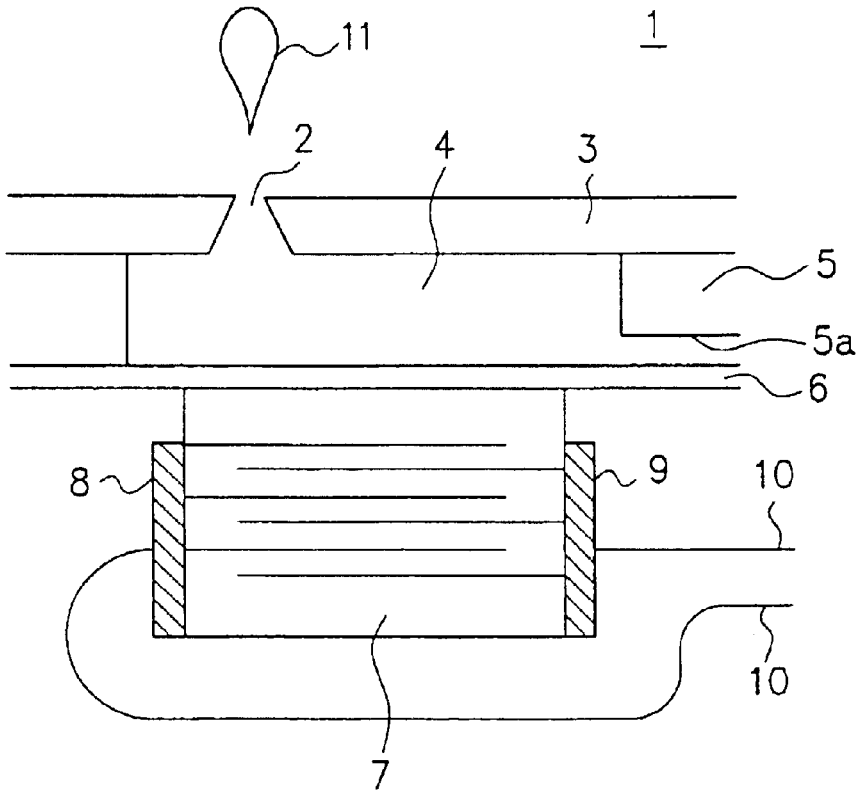
FIG. 17 is a sectional view showing an example of a mechanical configuration of a substantial part of an ink jet recording head according to a prior art.

FIG. 1 is a block diagram schematically showing an electric configuration of an ink jet recording head driving circuit whereto a an ink jet recording head driving method according to the first embodiment of the present invention is applied. A mechanical configuration of a substantial part of an ink jet printer and a substantial part of an ink jet recording head whereon an ink jet recording head driving circuit is mounted is almost the same as a configuration shown in FIG. 17 and FIG. 18 and thus abbreviated in this embodiment. However, as shown in FIG. 2, an ink jet recording head 1 in accordance with the first embodiment comprises four nozzles $\mathbf{2}_1$ to $\mathbf{2}_4$ positioned at fixed intervals in a sub-scanning direction, and as shown in FIG. 1, four piezoelectric actuators $\mathbf{7}_1$ to $\mathbf{7}_4$ corresponding to the four nozzles.

An ink jet recording head driving circuit shown in FIG. 1 is schematically almost configured with a control unit 31, a drive waveform storage means 32, a waveform generating unit 33 and a switching unit 34.

The control unit 31, on the basis of a control command CMC supplied from outside, outputs control signals $S_{C1}$ for controlling a head drive motor which drives an ink jet recording head 1 and control signals $S_{C2}$ for controlling a feed motor which drives a feed roller 14. At the same time, the control unit 31 supplies waveform/nozzle selecting data DSWN to the switching unit 34 on the basis of printing data DP including gray scale information, which is supplied from outside. Waveform/nozzle selecting data DSWN indicates whether any one or none of drive waveform signals (described later) supplied from three waveform generating circuits $\mathbf{35}_n$ to $\mathbf{35}_c$ should be applied to corresponding piezoelectric actuator 7 of four piezoelectric actuators $\mathbf{7}_1$ to $\mathbf{7}_4$. Additionally, the control unit 31 at every main scanning reads out drive waveform information on three adequate drive waveform signals from the drive waveform storage means 32 and supplies to the waveform generating unit 33. At the same time, when a printing start command CMP is supplied from outside at every main scanning, the control unit 31 supplies the necessitated times of a discharging start command to the waveform generating unit 33.

Figure 3:
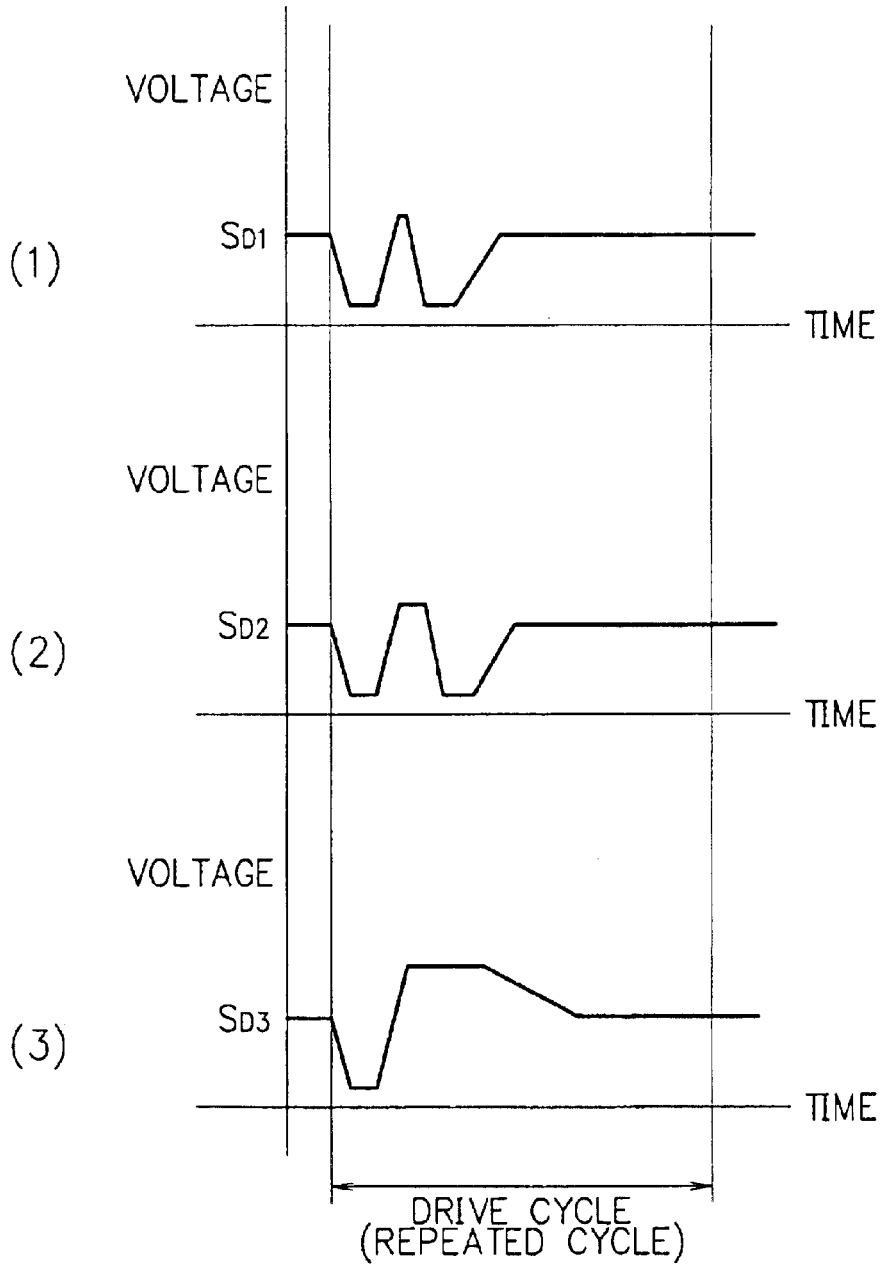
FIG. 3 is a diagram showing an example of a waveform of drive waveform signals SD1 to SD3 according to the first embodiment.
Figure 4:
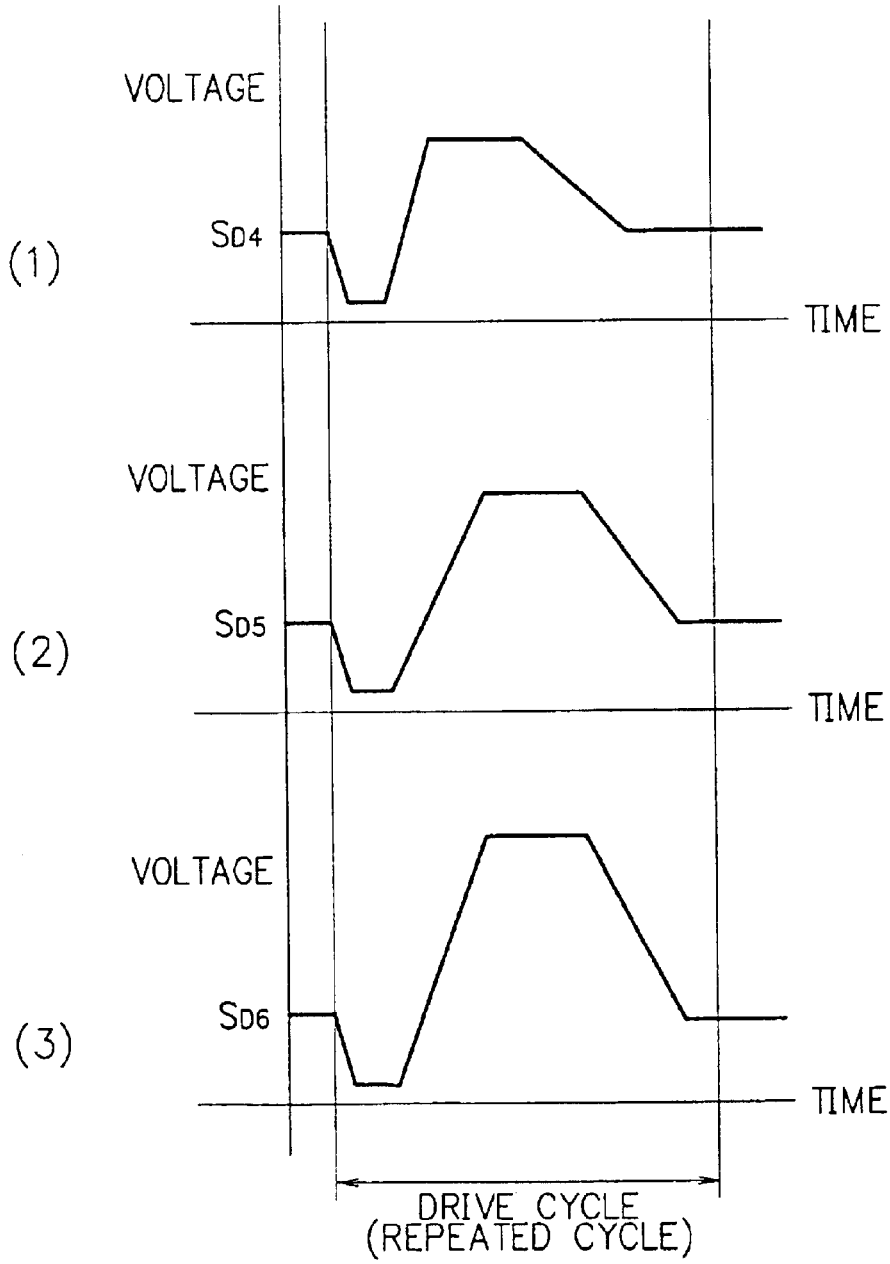
FIG. 4 is a diagram showing an example of a waveform of drive waveform signals SD4 to SD6 according to the first embodiment.
Figure 5:
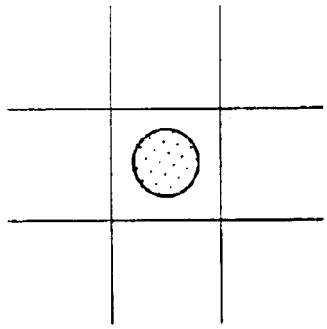
FIG. 5 is a diagram showing an example of dots D1 to D3 formed on a recording medium on the basis of drive waveform signals SD1 to SD3 according to the first embodiment.
Figure 5:
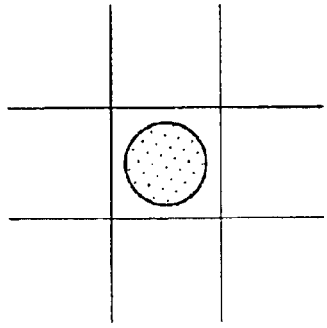
Figure 5:
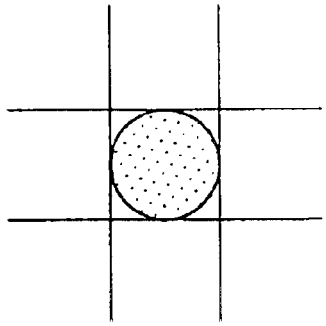
Figure 6:
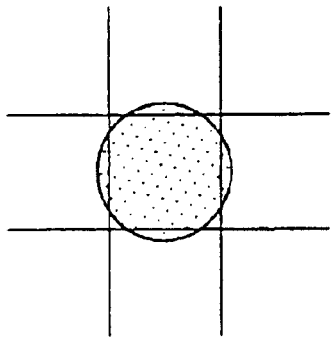
FIG. 6 is a diagram showing an example of dots D4 to D6 formed on a recording medium on the basis of drive waveform signals each SD4 to SD6 according to the first embodiment.
Figure 6:
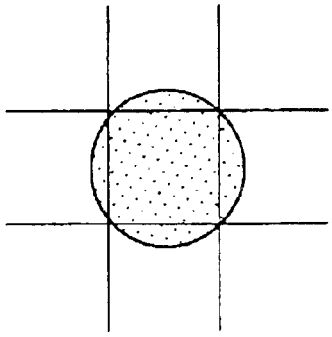
Figure 6:
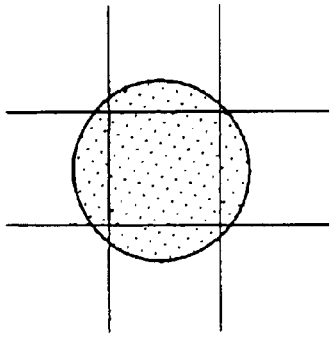

The drive waveform storage means 32 composed of ROM for instance, precedently stores drive waveform information on drive waveforms concerning drive waveform signals $S_{D1}$ to $S_{D6}$ having a variety of jet amounts of ink droplets, which should be applied to four piezoelectric actuators 7, to 74. FIGS. 3 and 4 show an example of a waveform of drive waveform signals $S_{D1}$ to $S_{D6}$. FIG. 5 and FIG. 6 show an example of dots $D_1$ to $D_6$ formed on a recording medium on the basis of the drive waveform signals $S_{D1}$ to $S_{D6}$. In FIG. 5 and FIG. 6, an area surrounded by four lines indicates a position of one pixel on a recording medium.

The waveform generating unit 33 comprises waveform generating circuits $\mathbf{35}_a$ to $\mathbf{35}_c$ and three power amplifying circuits (not shown in FIG. 1) provided corresponding to each of waveform generating circuits $\mathbf{35}_a$ to $\mathbf{35}_c$ and so on. After each of the waveform generating circuits $\mathbf{35}_a$ to $\mathbf{35}_c$ generates drive waveform signals on the basis of drive waveform information supplied from the control unit 31 at every main scanning, the corresponding power amplifying circuit amplifies the drive waveform signals and the waveform generating unit 33 supplies the amplified drive waveform signals to the switching unit 34 on the basis of a discharging start command supplied from the control unit 31.

The switching unit 34 comprises a waveform selecting circuit 36 and a total of twelve switches $\mathbf{37}_{1a}$ to $\mathbf{37}_{1c}$, $\mathbf{37}_{2a}$ to $\mathbf{37}_{2c}$, $\mathbf{37}_{3a}$ to $\mathbf{37}_{3c}$, and $\mathbf{37}_{4a}$ to $\mathbf{37}_{4c}$ and so on, composed of transfer gates for instance, and provided to be corresponding to four piezoelectric actuators $\mathbf{7}_{1a}$ to $\mathbf{7}_4$, at the same time, to three waveform generating circuits $\mathbf{35}_a$ to $\mathbf{35}_c$ for every piezoelectric actuator 7. On the basis of waveform/nozzle selecting data DSWN supplied from the control unit 31, the waveform selecting circuit 36 turns on any one or none of the switches 7 for every piezoelectric actuator 7, and thus the switching unit 34 applies any one or none of amplified drive waveform signals supplied from three power amplifying circuits constructing the waveform generating unit 33, to the corresponding piezoelectric actuator 7.

The waveform/nozzle selecting data DSWN is parallel data with 3 bits which is set to be "0" in case of turning off each switch 37 for each piezoelectric actuator 7 and set to be "1" in case of turning on each switch 37. In other words, since three switches 37 are connected to each piezoelectric actuator 7, the waveform/nozzle selecting data DSWN for each piezoelectric actuator 7 will be set as follows; "000" in case when none of the drive waveform signals supplied from the waveform generating circuits $\mathbf{35}_a$ to $\mathbf{3}_c$ are applied to the corresponding piezoelectric actuator 7, "001" in case when drive waveform signals supplied from the waveform generating circuit $\mathbf{35}_c$ are applied to the corresponding piezoelectric actuator 7, "010" in case when drive waveform signals supplied from the waveform generating circuit $\mathbf{35}_b$ are applied to the corresponding piezoelectric actuator 7, and "100" in case when drive waveform signals supplied from the waveform generating circuit $\mathbf{35}_a$ are applied to the corresponding piezoelectric actuator 7.

Figures 7, 8:
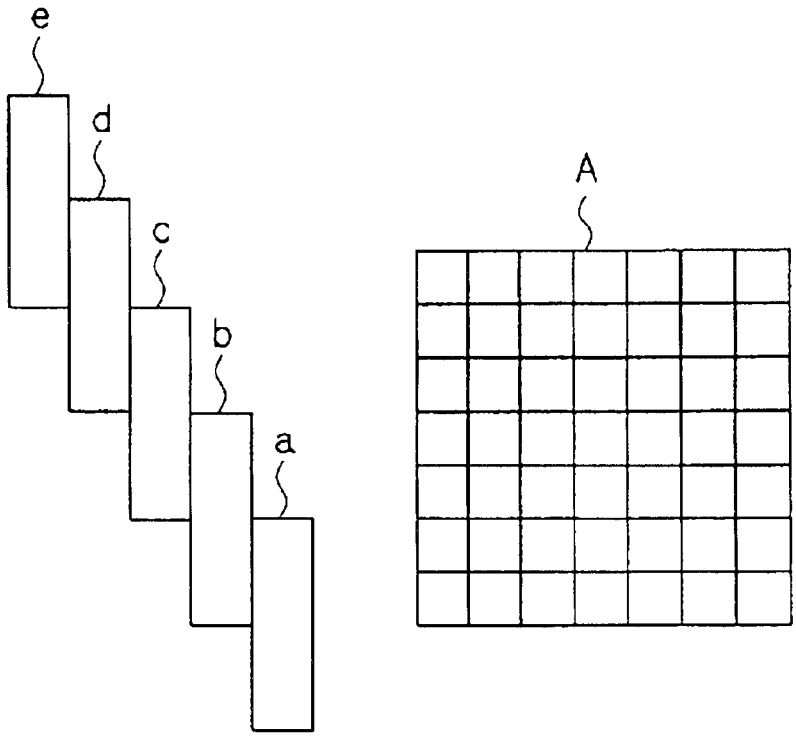
FIG. 7 is a diagram for explaining an example of gray scale printing according to the first embodiment.
FIG. 8 is a diagram for explaining physical relationship between a recording area A of a recording medium and an ink jet recording head according to the first embodiment.

In the following, an explanation will be given on recording operation (including the case when recording is not executed) of picture images with 7 gray scales shown in FIG. 7, which executed within the seven-by-seven pixel area of a recording medium by an ink jet recording head driving circuit of the aforementioned configuration. In FIG. 7, each square area shows one pixel position on a recording medium and each numeral shows gray scale value, that is, a dot size formed on a recording medium. A blank square area shows the case when recording is not executed. Gray scale values 1 to 6 are corresponding to the dots $D_1$ to $D_6$ shown in FIG. 5 and FIG. 6.

First of all, the control unit 31, on the basis of a control command CMC supplied from outside, supplies control signals $S_{C1}$ to a head drive motor (not shown) and positions an ink jet recording head 1 at a home position (a position determined when recording starts) by moving the ink jet recording head 1 to a main scanning direction. After such process, the control unit 31 supplies control signals $S_{C2}$ to a feed motor (not shown) and, as shown in FIG. 8, moves a recording medium by rotating a feed roller 14 so that the ink jet recording head 1 will be positioned at "a" in regard to a recording area "A" with seven-by-seven pixels of a recording medium. Secondly, the control unit 31 reads out drive waveform information on drive waveform signals $S_{D1}$, $S_{D3}$ and $S_{D5}$ shown in FIG. 3(1), FIG. 3(3) and FIG. 4(2), and supplies the information to a waveform generating unit 33. Thereafter, the control unit 31 supplies control signals $S_{C1}$ to a head drive motor (not shown) and slides the ink jet recording head 1 to a main scanning direction (from the left to the right in FIG. 8). At the same time, on the basis of printing start command CMP supplied from outside, the control unit 31 supplies the necessitated times (seven times in this case) of a discharging start command to the waveform generating unit 33 and supplies the waveform/nozzle selecting data DSWN corresponding to a gray scale value of a pixel position on a recording medium (referring to FIG. 7) to the switching unit 34 at every discharging start command.

Thereby, the ink jet recording head 1 moves to a main scanning direction (from the left to the right in FIG. 8). At the same time, after each of waveform generating circuits $\mathbf{35}_a$ to $\mathbf{35}_c$ generates drive waveform signals $S_{D1}$, $S_{D3}$ and $S_{D5}$ in the waveform generating unit 33 on the basis of drive waveform information on drive waveform signals $S_{D1}$, $S_{D3}$ and $S_{D5}$, the corresponding power amplifying circuit amplifies the drive waveform signals and the waveform generating unit 33 supplies the amplified drive waveform signals to the switching unit 34 on the basis of seven times of a discharging start command supplied from the control unit 31. Accordingly, in the switching unit 34, the waveform selecting circuit 36 turns on any one or none of the switches 37 for every piezoelectric actuator 7 on the basis of waveform/nozzle selecting data DSWN supplied from the control unit 31, and thus the switching unit 34 applies any one or none of amplified drive waveform signals supplied from three power amplifying circuits constructing the waveform generating unit 33, to the corresponding piezoelectric actuator 7.

Thereby, an ink droplet 11 is discharged from a nozzle 2 corresponding to a piezoelectric actuator 7 whereto amplified drive waveform signals $S_{D1}$, $S_{D3}$ and $S_{D5}$ are applied. And thus, in a recording area "A" of a recording medium, as shown in FIG. 9(1), dots with the gray scale levels 1, 3 and 5 (equivalent to a dot $D_1$ in FIG. 5(1), a dot $D_3$ in FIG. 5(3) and a dot $D_5$ in FIG. 6(2)) are formed. At the same time, none of dots are formed in a pixel position at a lower right corner. The aforementioned process is referred to as a first main scanning process.

Next, the control unit 31 supplies control signals $S_{C1}$ to a head drive motor (not shown) and positions an ink jet recording head 1 at a home position by sliding the ink jet recording head 1 to a main scanning direction (from the right to the left in FIG. 8). After such process, the control unit 31 supplies control signals $S_{C2}$ to a feed motor (not shown) and, as shown in FIG. 8, moves a recording medium by rotating a feed roller 14 so that the ink jet recording head 1 will be positioned at "b" in regard to a recording area "A" of a recording medium. In a practical sense, the lower part of the position "b" overlaps the position "a", however, as shown in FIG. 8, "a" and "b" are adjacently positioned for the sake of convenience. Then, the control unit 31 reads out drive waveform information on drive waveform signals $S_{D2}$, $S_{D4}$ and $S_{D6}$ shown in FIG. 3(2), FIG. 4(1) and FIG. 4(3) from a drive waveform storage means 32, and supplies the information to a waveform generating unit 33. Thereafter, the control unit 31 supplies control signals $S_{C1}$ to a head drive motor (not shown) and slides the ink jet recording head 1 to a main scanning direction (from the left to the right in FIG. 8). At the same time, on the basis of a printing start command CMP supplied from outside, the control unit 31 supplies the necessitated times (seven times in this case) of discharging start commands to the waveform generating unit 33 and supplies the waveform/nozzle selecting data DSWN corresponding to a gray scale value of a pixel position on a recording medium (referring to FIG. 7) to the switching unit 34 at every discharging start command.

Thereby, the ink jet recording head 1 moves to a main scanning direction (from the left to the right in FIG. 8). At the same time, after each of waveform generating circuits $\mathbf{35}_a$ to $\mathbf{35}_c$ generates drive waveform signals $S_{D2}$, $S_{D4}$ and $S_{D6}$ in the waveform generating unit 33 on the basis of drive waveform information on drive waveform signals $S_{D2}$, $S_{D4}$ and $S_{D6}$, the corresponding power amplifying circuit amplifies the drive waveform signals and the waveform generating unit 33 supplies the amplified drive waveform signals to the switching unit 34 on the basis of seven times of discharging start commands supplied from the control unit 31. Accordingly, in the switching unit 34, the waveform selecting circuit 36 turns on any one or none of the switches 37 for every piezoelectric actuator 7 on the basis of waveform/nozzle selecting data DSWN supplied from the control unit 31, and thus the switching unit 34 applies any one or none of amplified drive waveform signals $S_{D2}$, $S_{D4}$ and $S_{D6}$ supplied from three power amplifying circuits constructing the waveform generating unit 33, to the corresponding piezoelectric actuator 7.

In accordance with the aforementioned process, an ink droplet 11 is discharged from a nozzle 2 corresponding to a piezoelectric actuator 7 whereto amplified drive waveform signals $S_{D2}$, $S_{D4}$ and $S_{D6}$ are applied. And thus, in a recording area "A" of a recording medium, as shown in FIG. 9(2), dots with the gray scale levels 2, 4 and 6 (equivalent to a dot $D_2$ in FIG. 5(2), a dot $D_4$ in FIG. 6(1) and a dot $D_6$ in FIG. 6(3)) are formed. The aforementioned process is referred to as a first main scanning process.

Next, the control unit 31 supplies control signals $S_{C1}$ to a head drive motor (not shown) and positions an ink jet recording head 1 at a home position by sliding the ink jet recording head 1 to a main scanning direction (from the right to the left in FIG. 8). After such process, the control unit 31 supplies control signals $S_{C2}$ to a feed motor (not shown) and, as shown in FIG. 8, moves a recording medium by rotating a feed roller 14 so that the ink jet recording head 1 will be positioned at "c" in regard to a recording area "A" of a recording medium. Then, by executing the same process as the aforementioned first main scanning process, in a recording area "A" of a recording medium, as shown in FIG. 9(3), dots with the gray scale levels 1, 3 and 5, that is, a dot $D_1$, a dot $D_3$ and a dot $D_6$ are formed (a third main scanning process). Thereafter, the control unit 31 supplies control signals $S_{C1}$ to a head drive motor (not shown) and positions an ink jet recording head 1 at a home position by moving the ink jet recording head 1 to a main scanning direction (from the right to the left in FIG. 8). After such process, the control unit 31 supplies control signals $S_{C2}$ to a feed motor (not shown) and, as shown in FIG. 8, moves a recording medium by rotating a feed roller 14 so that the ink jet recording head 1 will be positioned at "d" in regard to a recording area "A" of a recording medium. Then, by executing the same process as the aforementioned second main scanning process, in a recording area "A" of a recording medium, as shown in FIG. 10(1), dots with the gray scale levels 2, 4 and 6, that is, a dot $D_2$, a dot $D_4$ and a dot $D_6$ are formed (a fourth main scanning process). Thereafter, the control unit 31 supplies control signals $S_{C1}$ to a head drive motor (not shown) and positions an ink jet recording head 1 at a home position by moving the ink jet recording head 1 to a main scanning direction (from the right to the left in FIG. 8). After such process, the control unit 31 supplies control signals $S_{C2}$ to a feed motor (not shown) and, as shown in FIG. 8, moves a recording medium by rotating a feed roller 14 so that the ink jet recording head 1 will be positioned at "e" in regard to a recording area "A" of a recording medium. Then, by executing the same process as the aforementioned first main scanning process, in a recording area "A" of a recording medium, as shown in FIG. 10(2), dots with the gray scale levels 1, 3 and 5, that is, a dot $D_1$, a dot $D_3$ and a dot $D_5$ are formed. At the same time, none of dots are formed in a pixel position at a upper left corner (a fifth main scanning process). FIG. 10(2) is same as FIG. 7. This means that a picture mage shown in FIG. 7 is recorded on a recording medium through the first to fifth main scanning processes. In this way, according to the configuration of this example, since three kinds of drive waveform signals are selectable all at once, a picture image with 7 gray scales is able to be recorded by twice of main scanning processes for the same pixel position on a recording medium, and thus high-quality characters and picture images are to be recorded in high speed.

Figure 16:
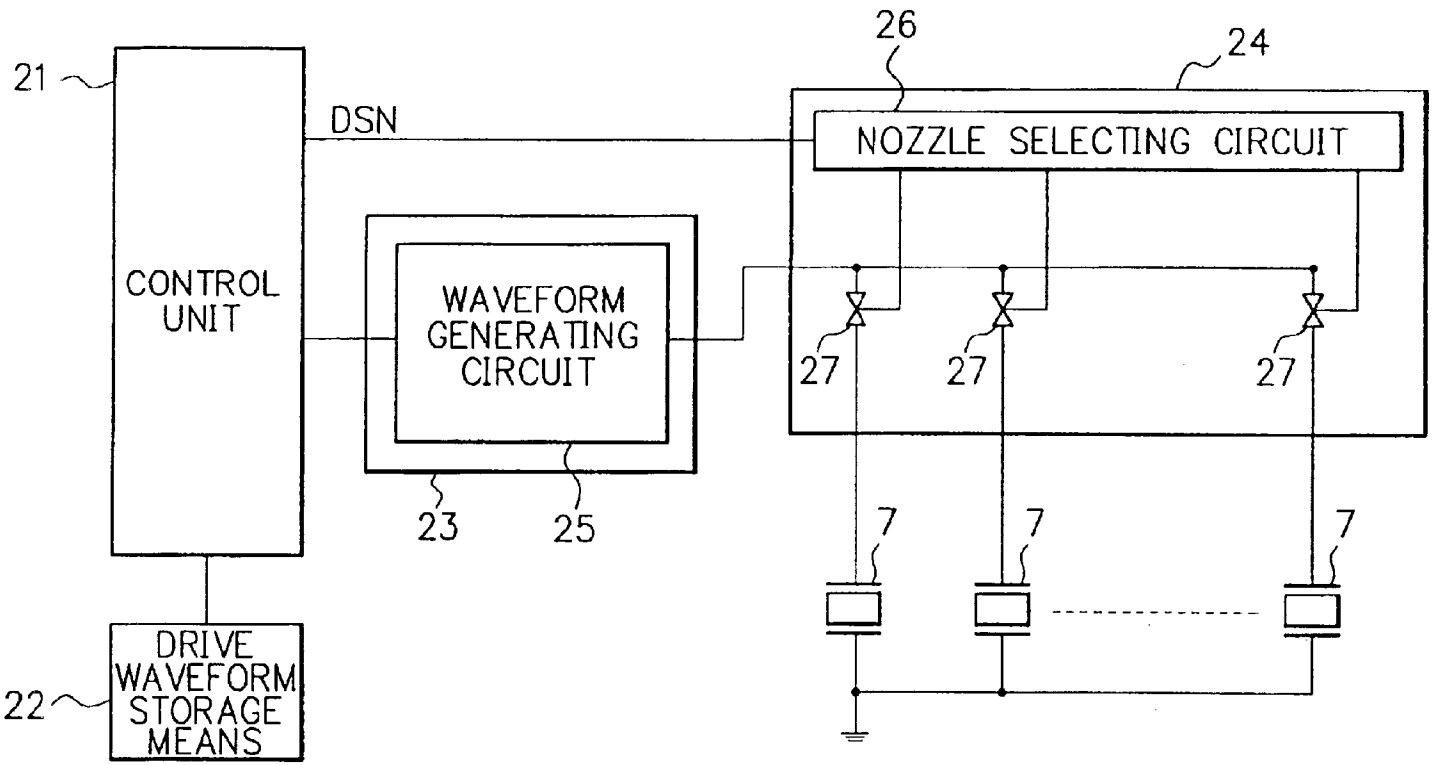
FIG. 16 is a block diagram showing an example of an electric configuration of an ink jet recording head driving circuit according to a first prior art.

On the contrary, according to the conventional ink jet printer having a configuration shown in FIG. 16, in case of recording a picture image with 7 gray scales, seven times of main scanning processes are required for the same pixel position on a recording medium. Consequently, a configuration of this example makes it possible to record a picture image with 7 gray scales in two seventh of time, comparing with the conventional ink jet printer.

Incidentally, according to a configuration of this example, nozzles 2, which are different from each other, at twice of main scanning processes (a main scanning process with odd number and a main scanning process with even number) for the same pixel position on a recording medium. In other words, since characters or picture images on an arbitrary line of a recording medium are recorded by ink droplets discharged from a plurality of nozzles 2, banding, which is caused by displacement of spotting positions of ink droplets owing to components or accidental error in production, becomes difficult to be noticed.

B. Second Embodiment

In the following, an explanation will be given on a second embodiment of the present invention.

An electric configuration of an ink jet recording head driving circuit and a mechanical configuration of a substantial part of an ink jet printer and an ink jet recording head, whereto an ink jet recording head driving method according to a second embodiment of the present invention is applied, are almost the same as that of the first embodiment, and thus whereof explanation will be abbreviated in the following.

In the following, an explanation will be given on recording operation of picture images with 7 gray scales shown in FIG. 7, which is executed within the seven-by-seven pixel area of a recording medium by an ink jet recording head driving method of the second embodiment of the present invention.

First of all, the control unit 31, on the basis of a control command CMC supplied from outside, supplies control signals $S_{C1}$ to a head drive motor (not shown) and positions an ink jet recording head 1 at a home position by sliding the ink jet recording head 1 to a main scanning direction (from the right to the left in FIG. 8). After such process, the control unit 31 supplies control signals $S_{C2}$ to a feed motor (not shown) and, as shown in FIG. 8, moves a recording medium by rotating a feed roller 14 so that the ink jet recording head 1 will be positioned at "a" in regard to a recording area "A" with seven-by-seven pixels of a recording medium. Secondly, the control unit 31 reads out drive waveform information on drive waveform signals $S_{D1}$ to $S_{D3}$ shown in FIGS. 3(1) to (3) from a drive waveform storage means 32, and supplies the information to a waveform generating unit 33. Thereafter, the control unit 31 supplies control signals $S_{C1}$ to a head drive motor (not shown) and slides the ink jet recording head 1 to a main scanning direction (from the left to the right in FIG. 8). At the same time, on the basis of a printing start command CMP supplied from outside, the control unit 31 supplies the necessitated times (seven times in this case) of discharging start commands to the waveform generating unit 33 and supplies the waveform/nozzle selecting data DSWN corresponding to a gray scale value of a pixel position on a recording medium (referring to FIG. 7) to the switching unit 34 at every discharging start command.

Thereby, the ink jet recording head 1 moves to a main scanning direction (from the left to the right in FIG. 8). At the same time, after each of waveform generating circuits $\mathbf{35}_a$ to $\mathbf{35}_c$ generates drive waveform signals $S_{D1}$ to $S_{D3}$ in the waveform generating unit 33 on the basis of drive waveform information on drive waveform signals $S_{D1}$ to $S_{D3}$, the corresponding power amplifying circuit amplifies the drive waveform signals and the waveform generating unit 33 supplies the amplified drive waveform signals to the switching unit 34 on the basis of seven times of discharging start commands supplied from the control unit 31. Accordingly, in the switching unit 34, the waveform selecting circuit 36 turns on any one or none of the switches 37 for every piezoelectric actuator 7 on the basis of waveform/nozzle selecting data DSWN supplied from the control unit 31, and thus the switching unit 34 applies any one or none of amplified drive waveform signals $S_{D1}$ to $S_{D3}$ supplied from three power amplifying circuits constructing the waveform generating unit 33, to the corresponding piezoelectric actuator 7.

Thereby, an ink droplet 11 is discharged from a nozzle 2 corresponding to a piezoelectric actuator 7 whereto amplified drive waveform signals $S_{D1}$ to $S_{D3}$ are applied. And thus, in a recording area "A" of a recording medium, as shown in FIG. 11(1), dots with the gray scale levels 1 to 3 (equivalent to dots $D_1$ to $D_3$ in FIG. 5(1) to (3)) are formed. And, none of dots are formed in a pixel position at a lower right corner of FIG. 11(1). The aforementioned process is referred to as a first main scanning process.

Next, the control unit 31 supplies control signals $S_{C1}$ to a head drive motor (not shown) and positions an ink jet recording head 1 at a home position by sliding the ink jet recording head 1 to a main scanning direction (from the right to the left in FIG. 8). After such process, the control unit 31 supplies control signals $S_{C2}$ to a feed motor (not shown) and, as shown in FIG. 8, moves a recording medium by rotating a feed roller 14 so that the ink jet recording head 1 will be positioned at "b" in regard to a recording area "A" of a recording medium. Then, the control unit 31 reads out drive waveform information on drive waveform signals $S_{D4}$ to $S_{D6}$ shown in FIGS. 4(1) to (3) from a drive waveform storage means 32, and supplies the information to a waveform generating unit 33. Thereafter, the control unit 31 supplies control signals $S_{C1}$ to a head drive motor (not shown) and moves the ink jet recording head 1 to a main scanning direction (from the left to the right in FIG. 8). At the same time, on the basis of a printing start command CMP supplied from outside, the control unit 31 supplies the necessitated times (seven times in this case) of discharging start commands to the waveform generating unit 33 and supplies the waveform/nozzle selecting data DSWN corresponding to a gray scale value of a pixel position on a recording medium (referring to FIG. 7) to the switching unit 34 at every discharging start command.

Thereby, the ink jet recording head 1 moves to a main scanning direction (from the left to the right in FIG. 8). At the same time, after each of waveform generating circuits $\mathbf{35}_a$ to $\mathbf{35}_c$ generates drive waveform signals $S_{D4}$ to $S_{D6}$ in the waveform generating unit 33 on the basis of drive waveform information on drive waveform signals $S_{D4}$ to $S_{D6}$, the corresponding power amplifying circuit amplifies the drive waveform signals and the waveform generating unit 33 supplies the amplified drive waveform signals to the switching unit 34 on the basis of seven times of a discharging start command supplied from the control unit 31. Accordingly, in the switching unit 34, the waveform selecting circuit 36 turns on any one or none of the switches 37 for every piezoelectric actuator 7 on the basis of waveform/nozzle selecting data DSWN supplied from the control unit 31, and thus the switching unit 34 applies any one or none of amplified drive waveform signals $S_{D4}$ to $S_{D6}$ supplied from three power amplifying circuits constructing the waveform generating unit 33, to the corresponding piezoelectric actuator 7.

Thereby, an ink droplet 11 is discharged from a nozzle 2 corresponding to a piezoelectric actuator 7 whereto amplified drive waveform signals $S_{D4}$ to $S_{D6}$ are applied. And thus, in a recording area "A" of a recording medium, as shown in FIG. 11(2), dots with the gray scale levels 4 to 6 (correspond to dots $D_4$ to $D_6$ in FIGS. 6(1) to (3)) are formed. The aforementioned process is referred to as a second main scanning process.

Figures 12, 13:
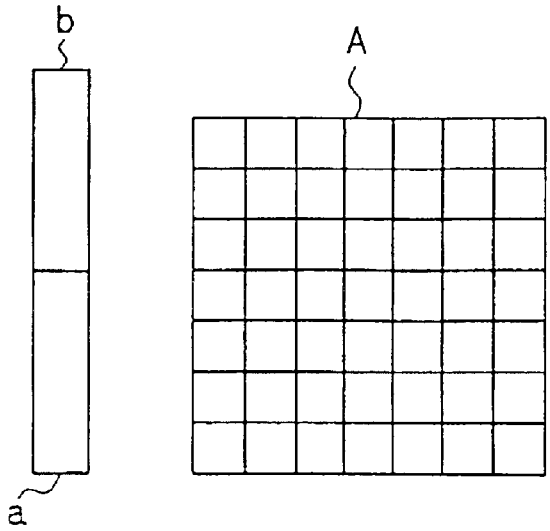
FIG. 12 is a diagram for explaining an ink jet recording head driving method according to the second embodiment.
FIG. 13 is a diagram for explaining physical relationship between a recording area A of a recording medium of a an ink jet recording head driving method and an ink jet recording head according to a third embodiment.

Next, the control unit 31 supplies control signals $S_{C1}$ to a head drive motor (not shown) and positions an ink jet recording head 1 at a home position by sliding the ink jet recording head 1 to a main scanning direction (from the right to the left in FIG. 8). After such process, the control unit 31 supplies control signals $S_{C2}$ to a feed motor (not shown) and, as shown in FIG. 8, moves a recording medium by rotating a feed roller 14 so that the ink jet recording head 1 will be positioned at "c" in regard to a recording area "A" of a recording medium. Then, by executing the same process as the aforementioned first main scanning process, in a recording area "A" of a recording medium, as shown in FIG. 11(3), dots with the gray scale levels 1 to 3, that is, dots $D_1$ to $D_3$ are formed (a third main scanning process). Thereafter, the control unit 31 supplies control signals $S_{C1}$ to a head drive motor (not shown) and positions an ink jet recording head 1 at a home position by sliding the ink jet recording head 1 to a main scanning direction (from the right to the left in FIG. 8). After such process, the control unit 31 supplies control signals $S_{C2}$ to a feed motor (not shown) and, as shown in FIG. 8, moves a recording medium by rotating a feed roller 14 so that the ink jet recording head 1 will be positioned at "d" in regard to a recording area "A" of a recording medium. Then, by executing the same process as the aforementioned second main scanning process, in a recording area "A" of a recording medium, as shown in FIG. 12(1), dots with the gray scale levels 4 to 6, that is, dots $D_2$ to $D_4$ are formed (a fourth main scanning process). Thereafter, the control unit 31 supplies control signals $S_{C1}$ to a head drive motor (not shown) and positions an ink jet recording head 1 at a home position by sliding the ink jet recording head 1 to a main scanning direction (from the right to the left in FIG. 8). After such process, the control unit 31 supplies control signals $S_{C2}$ to a feed motor (not shown) and, as shown in FIG. 8, moves a recording medium by rotating a feed roller 14 so that the ink jet recording head 1 will be positioned at "e" in regard to a recording area "A" of a recording medium. Then, by executing the same process as the aforementioned first main scanning process, in a recording area "A" of a recording medium, as shown in FIG. 12(2), dots with the gray scale levels 1 to 3, that is, dots $D_1$ to $D_3$ are formed. At the same time, none of dots are formed in a pixel position at a upper left corner (a fifth main scanning process). FIG. 12(2) is same as FIG. 7, which means that a picture mage shown in FIG. 7 is recorded on a recording medium through the first to fifth main scanning processes.

In this way, according to the configuration of this example, dots with a small diameter and dots with a large diameter are recorded by a respective main scanning. Consequently, in addition to the advantages attained in the aforementioned first embodiment, clear dots are to be formed even in case of recording by use of a recording medium whereon ink is blurred easily or dried slowly, because of the following reason. When recording is executed by use of a recording medium whereon ink is blurred easily or dried slowly, in case that a large dot and a small dot are adjacently formed at a short time, these dots are mixed and thus it is possible that clear dots cannot be formed. However, as shown in this embodiment, when dots with a small diameter and dots with a large diameter are recorded by a respective main scanning, since time needed for forming dots with a small diameter and dots with a large diameter becomes longer, even if a recording medium whereon ink is blurred easily or dried slowly, clear dots are formed because dots with a small diameter and dots with a large diameter are not mixed.

C. Third Embodiment

In the following, an explanation will be given on a third embodiment of the present invention.

An electric configuration of an ink jet recording head driving circuit and a mechanical configuration of a substantial part of an ink jet printer and an ink jet recording head, whereto an ink jet recording head driving method according to a third embodiment of the present invention is applied, are nearly the same as that of the aforementioned first embodiment, and thus whereof explanation will be abbreviated in the following.

In the following, an explanation will be given on recording operation of picture images with 7 gray scales shown in FIG. 7, which is executed within the seven-by-seven pixel area of a recording medium by an ink jet recording head driving method of the third embodiment of the present invention.

First of all, the control unit 31, on the basis of a control command CMC supplied from outside, supplies control signals $S_{C1}$ to a head drive motor (not shown) and positions an ink jet recording head 1 at a home position by sliding the ink jet recording head 1 to a main scanning direction (from the right to the left in FIG. 13). After such process, the control unit 31 supplies control signals $S_{C2}$ to a feed motor (not shown) and, as shown in FIG. 13, moves a recording medium by rotating a feed roller 14 so that the ink jet recording head 1 will be positioned at "a" in regard to a recording area "A" with seven-by-seven pixels of a recording medium. Secondly, the control unit 31 reads out drive waveform information on drive waveform signals $S_{D1}$, $S_{D3}$ and $S_{D5}$ shown in FIG. 3(1), FIG. 3(3) and FIG. 4(2), and supplies the information to a waveform generating unit 33. Thereafter, the control unit 31 supplies control signals $S_{C1}$ to a head drive motor (not shown) and slides the ink jet recording head 1 to a main scanning direction (from the left to the right in FIG. 13). At the same time, on the basis of a printing start command CMP supplied from outside, the control unit 31 supplies the necessitated times (seven times in this case) of discharging start commands to the waveform generating unit 33 and supplies the waveform/nozzle selecting data DSWN corresponding to a gray scale value of a pixel position on a recording medium (referring to FIG. 7) to the switching unit 34 at every discharging start command.

Thereby, the ink jet recording head 1 moves to a main scanning direction (from the left to the right in FIG. 13). At the same time, after each of waveform generating circuits $\mathbf{35}_a$ to $\mathbf{35}_c$ generates drive waveform signals $S_{D1}$, $S_{D3}$ and $S_{D5}$ in the waveform generating unit 33 on the basis of drive waveform information on drive waveform signals $S_{D1}$, $S_{D3}$ and $S_{D5}$, the corresponding power amplifying circuit amplifies the drive waveform signals and the waveform generating unit 33 supplies the amplified drive waveform signals to the switching unit 34 on the basis of seven times of discharging start commands supplied from the control unit 31. Accordingly, in the switching unit 34, the waveform selecting circuit 36 turns on any one or none of the switches 37 for every piezoelectric actuator 7 on the basis of waveform/nozzle selecting data DSWN supplied from the control unit 31, and thus the switching unit 34 applies any one or none of amplified drive waveform signals $S_{D1}$, $S_{D3}$ and $S_{D5}$, supplied from three power amplifying circuits constructing the waveform generating unit 33, to the corresponding piezoelectric actuator 7. In accordance with the aforementioned process, an ink droplet 11 is discharged from a nozzle 2 corresponding to a piezoelectric actuator 7 whereto amplified drive waveform signals $S_{D1}$, $S_{D3}$ and $S_{D5}$ are applied. And thus, in a recording area "A" of a recording medium, as shown in FIG. 14(1), dots with the gray scale levels 1, 3 and 5 (equivalent to a dot $D_1$ in FIG. 5(1), a dot $D_3$ in FIG. 5(3) and a dot $D_5$ in FIG. 6(2)) are formed. At the same time, none of dots are formed in a pixel position at a lower right corner of FIG. 14(1). The aforementioned process is referred to as a first main scanning process.

Next, the control unit 31 reads out drive waveform information on drive waveform signals $S_{D2}$, $S_{D4}$ and $S_{D6}$ shown in FIG. 3(2), FIG. 4. (1) and FIG. 4(3) from a drive waveform storage means 32, and supplies the information to a waveform generating unit 33.

Thereafter, the control unit 31 supplies control signals $S_{C1}$ to a head drive motor (not shown) and slides the ink jet recording head 1 to a main scanning direction (from the left to the right in FIG. 13). At the same time, on the basis of a printing start command CMP supplied from outside, the control unit 31 supplies the necessitated times (seven times in this case) of discharging start commands to the waveform generating unit 33 and supplies the waveform/nozzle selecting data DSWN corresponding to a gray scale value of a pixel position on a recording medium (referring to FIG. 7) to the switching unit 34 at every discharging start command.

Thereby, the ink jet recording head 1 moves to a main scanning direction (from the left to the right in FIG. 13). At the same time, after each of waveform generating circuits $\mathbf{35}_a$ to $\mathbf{35}_c$ generates drive waveform signals $S_{D2}$, $S_{D4}$ and $S_{D6}$ in the waveform generating unit 33 on the basis of drive waveform information on drive waveform signals $S_{D2}$, $S_{D4}$ and $S_{D6}$, the corresponding power amplifying circuit amplifies the drive waveform signals and the waveform generating unit 33 supplies the amplified drive waveform signals to the switching unit 34 on the basis of seven times of discharging start commands supplied from the control unit 31. Accordingly, in the switching unit 34, the waveform selecting circuit 36 turns on any one or none of the switches 37 for every piezoelectric actuator 7 on the basis of waveform/nozzle selecting data DSWN supplied from the control unit 31, and thus the switching unit 34 applies any one or none of amplified drive waveform signals $S_{D2}$, $S_{D4}$ and $S_{D6}$ supplied from three power amplifying circuits constructing the waveform generating unit 33, to the corresponding piezoelectric actuator 7. In accordance with the aforementioned process, an ink droplet 11 is discharged from a nozzle 2 corresponding to a piezoelectric actuator 7 whereto amplified drive waveform signals $S_{D2}$, $S_{D4}$ and $S_{D6}$ are applied. And thus, in a recording area "A" of a recording medium, as shown in FIG. 14(2), dots with the gray scale levels 2, 4 and 6 (equivalent to a dot $D_2$ in FIG. 5(2), a dot $D_4$ in FIG. 6(1) and a dot $D_6$ in FIG. 6(3)) are formed. The aforementioned process is referred to as a second main scanning process.

Next, the control unit 31 supplies control signals $S_{C1}$ to a head drive motor (not shown) and positions an ink jet recording head 1 at a home position by sliding the ink jet recording head 1 to a main scanning direction (from the right to the left in FIG. 13). After such process, the control unit 31 supplies control signals $S_{C2}$ to a feed motor (not shown) and, as shown in FIG. 13, moves a recording medium by rotating a feed roller 14 so that the ink jet recording head 1 will be positioned at "b" in regard to a recording area "A" of a recording medium. Then, by executing the same process as the aforementioned first main scanning process, in a recording area "A" of a recording medium, as shown in FIG. 9(3), dots with the gray scale levels 1, 3 and 5, that is, a dot $D_1$, a dot $D_3$ and a dot $D_5$ are formed (a third main scanning process). Thereafter, the control unit 31 supplies control signals $S_{C1}$ to a head drive motor (not shown) and positions an ink jet recording head 1 at a home position by sliding the ink jet recording head 1 to a main scanning direction (from the right to the left in FIG. 13). After such process, by executing the same process as the aforementioned second main scanning process, in a recording area "A" of a recording medium, as shown in FIG. 15(2), dots with the gray scale levels 2, 4 and 6, that is, a dot $D_2$, a dot $D_4$ and a dot $D_6$ are formed. At the same time, none of dots are formed in a pixel position at a upper left corner (a fourth main scanning process). FIG. 15(2) is same as FIG. 7. This means that a picture mage shown in FIG. 7 is recorded on a recording medium through the first to fourth main scanning processes.

In this way, according to the configuration of this example, since three kinds of drive waveform signals are selectable all at once, a picture image with 7 gray scales is able to be recorded by twice of main scanning processes for the same pixel position on a recording medium, and thus high-quality characters and picture images are to be recorded in high speed.

Incidentally, according to a configuration of this example, same nozzles 2 scan at twice of main scanning processes (a main scanning process with odd number and a main scanning process with even number) for the same pixel position on a recording medium. In other words, since characters or picture images on an arbitrary line of a recording medium are recorded by ink droplets discharged from the same nozzle 2, the bad effects, caused by misalignment of mechanical system or uneven stitch length of a recording medium concerning accuracy of a feed motor or a feed operation, can be reduced. Consequently, high-quality characters and picture images are to be recorded.

While the above explanation has been given in detail referring to embodiments and drawings of the present invention, the design of the specific configuration of the embodiment can be modified in various ways within the scope and spirit of the present invention.

For example, in each of the aforementioned embodiments, an example has been given on gray scale printing by use of a single color. However, it goes without saying that gray scale printing of colors can be executed by providing an ink jet recording head with nozzles which discharge ink droplets with a plurality of colors.

Further, in each of the aforementioned embodiments, an example has been given on gray scale printing with 7 gray scales, however any number of gray scales can be applied.

Still further, in each of the aforementioned embodiments, an example has been given on the case that one ink droplet is spotted on an arbitrary pixel position of a recording medium. However, gray scale printing of characters and picture images with higher gray scale levels can be executed by spotting a plurality of ink droplets on the same pixel position.

Also, in each of the aforementioned embodiments, an example has been given on the case that the control unit 31 supplies parallel waveform/nozzle selecting data DSWN to the switching unit 34. However, such configuration can be possible as serial waveform and nozzle selecting data DSWN are supplied, or gray scale value data for each of nozzles 21 to 24 is supplied by providing the switching unit 34 with decoder. Incidentally, in case that ink droplets are not discharged from a nozzle 2 to a recording medium, it is possible to generate drive waveform signals which vibrate a piezoelectric actuator 7 to the extent that ink droplets are not discharged from a nozzle 2, and then increase the number of switches 37 for each piezoelectric actuator 7 one by one so that the drive waveform signals are to be applied to a piezoelectric actuator 7.

Further, in each of the aforementioned embodiments, an example has been given on the case that the control unit 31 supplies a discharging start command to a waveform generating unit 33. However, a configuration can be modified as a position detecting means such as encoder, which detects a position of an ink jet recording head 1, is provided whereby an ink jet recording head 1 is detected when passing a given pixel position, and thus a discharging start command is supplied to a waveform generating unit 33 at every detection.

Still further, in each of the aforementioned embodiments, an example has been given on four nozzles 2 being provided. However, any number of nozzles can be used. Also, a spacing between nozzles 2 (a nozzle pitch) is not limited to the spacing shown in FIG. 2, and any spacing can be applied. Incidentally, in each of the aforementioned embodiments, an example has been given on the case that the control unit 31 selects such as drive waveform signals. However, configuration can be modified so that drive waveform signals can be selected on the basis of controls from outside.

Figure 18:
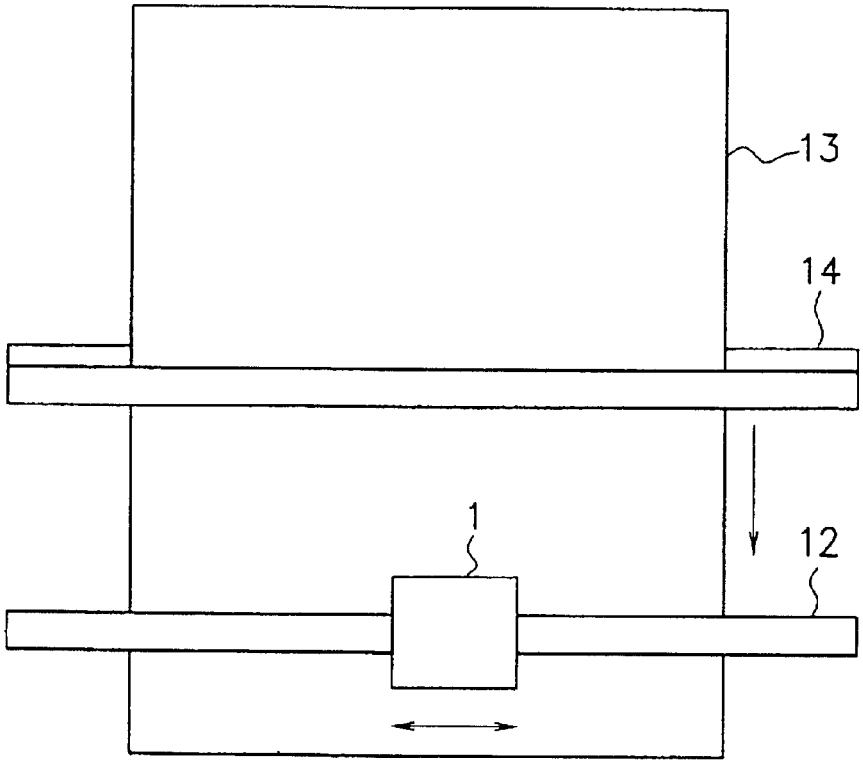
FIG. 18 is a plan view showing an example of a mechanical configuration of a substantial part of an ink jet recording head according to a prior art.
Figure 19:
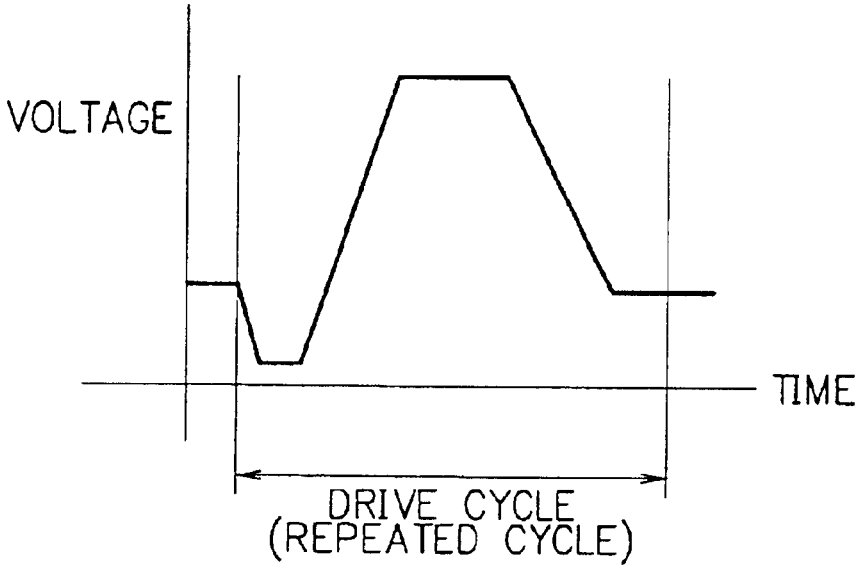
FIG. 19 is a diagram showing an example of a waveform of drive waveform signals according to a first prior art.
Figure 20:
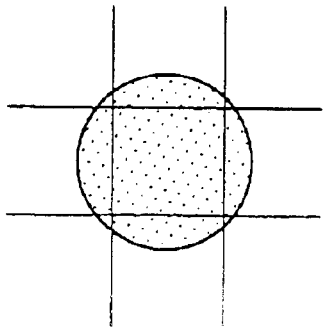
FIG. 20 is a diagram showing an example of dots formed on a recording medium according to the first prior art.

In addition, in each of the aforementioned embodiments, an example has been given on the case that ink droplets are discharged only when an ink jet recording head 1 moves from the left to the right in FIG. 18, making a home position as, a basic point. However, a configuration can be modified so that ink droplets are discharged only when an ink jet recording head 1 moves from the right to the left in FIG. 18, making a home position as a basic point. Also, ink droplets can be discharged when an ink jet recording head 1 moves both from the left to the right and from the right to the left in FIG. 18, which is capable of gray scale printing in higher speed.

Additionally, in each of the aforementioned embodiments, an example has been given on three waveform generating circuits $\mathbf{35}_a$ to $\mathbf{35}_c$ being provided. However, any number, if it is more than one, of waveform generating circuits can be provided.

Further, in each of the aforementioned embodiments, an example has been given on the case that an ink jet recording head 1 slides, while by a recording medium is fixed. However, a configuration can be modified so that an ink jet recording bead 1 is fixed and a recording medium moves in a main scanning direction.

Still further, in each of the aforementioned embodiments, an example has been given on the case that three drive waveform signals, which are selected at two consecutive times of main scanning processes, should be different from each other. However, it is acceptable if at least one of the three drive waveform signals is different from two drive waveform signals.

Incidentally, in each of the aforementioned embodiments, an example has been given on the case that recording is executed only in the recording area "A" with seven-by-seven pixels of a recording medium. However, it goes without describing that gray scale printing can be executed in the whole area of a recording medium through the same process.

Additionally, in each of the aforementioned embodiments, an example has been given on the case that an ink jet recording head 1 moves at the upper part of a recording medium positioned on a horizontal surface, and ink droplets are discharged to the downward direction. However, any structures can be applied if it meets the conditions that an ink jet recording head 1 slides along the surface opposed to a recording medium. Further, in the aforementioned first embodiment, an example has been given on the case that a combination of three drive waveform signals is selected by odd number and even number of main scanning processes, in consideration of five times of main scanning processes in the area "A" and twice of scanning at the same pixel position. However, a configuration can be modified so that in case of more than twice of scanning are executed at the same pixel position, a combination of drive waveform signals is selected on the basis of the odd number calculated by subtracting the number of times of scanning at the same pixel position from the number of times of main scanning processes.

The relation between the number of times of scanning at the same pixel position and the selection of a combination of drive waveform signals is affected by correlation between printing time and image quality. In other words, if priority given to printing time, high-quality image cannot be expected, and if priority is given to image quality, printing times can be longer.

For instance, a configuration can be modified so that on the basis of the image quality mode set up by an operator, a CPU (central processing unit) which controls each unit of an ink jet printer or configures an information processing device such as a personal computer supplying printing data to an ink jet printer, selects a combination between the number of times of scanning at the same pixel position and drive waveform signals, and supplies the related data to the control unit 31. A high-speed printing mode or a high-quality image mode can be considered as an example of an image quality mode. A high-speed printing mode is set up when a high-speed printing is required even in an image quality is low, for example in such a case as a test printing in order to check the entire layout of a picture image. A high-quality image mode is set up when a high-quality printing is required even if it will tale longer time. Incidentally, a configuration can be modified so that the control unit 31 selects the number of times of scanning at the same pixel position and a combination of drive waveform signals on the basis of data concerning a image quality mode supplied from the aforementioned CPU of an ink jet printer or CPU constructing an information processing device.

Additionally, in the aforementioned second embodiment, an example has been given on the case that dots $D_1$ to $D_3$ with a small diameter are formed at the first, third and fifth scanning process, and dots $D_4$ to $D_6$ with a large diameter are formed at the second and fourth scanning processes. However, a configuration can be modified so that dots $D_4$ to $D_6$ with a large diameter are formed at the first, third and fifth scanning process, and dots $D_1$ to $D_3$ with a small diameter are formed at the second and fourth scanning processes.

INDUSTRIAL APPLICABILITY

As explained above, according to a configuration of the present invention, high-quality gray scale (tone gradation) printing can be realized in a short time by use of an ink jet recording head having a simple and low-cost configuration and a general-purpose structure or ink having common components. Also, since a variety of gray scales can be attained by a small number of times of scanning, the number of ink droplets spotted on one pixel of a recording medium is small, and thus lowering of recording image quality can be prevented.

Incidentally, according to another configuration of the present invention, since the two dot forming processes; a dot forming process which generates a plurality of drive waveform signals for discharging ink droplets with a relatively high jet amount and a dot forming process which generates a plurality of drive waveform signals for discharging ink droplets with a relatively low jet amount, are executed interchangeably, clear dots are to be formed even if recording is executed on a recording medium whereon ink is blurred easily or dried slowly.

Further, according to another configuration of the present invention, since nozzles positioned at different places of a plurality of nozzles pass the same position of a recording medium at every dot forming process, banding, which is caused by displacement of spotting positions of ink droplets owing to components or accidental error in production, becomes difficult to be noticed.

Still further, according to another configuration of the present invention, since nozzles positioned at different places of a plurality of nozzles pass through the same position of a recording medium at every dot forming process, the bad effects, caused by misalignment of mechanical system or uneven stitch length of a recording medium concerning accuracy of a feed motor or a feed operation, can be reduced. Consequently, high-quality characters and picture images are to be recorded.

What is claimed is:

1. An ink jet recording head driving method, the ink jet recording head having at least one nozzle and at least one corresponding pressure generating chamber and a piezoelectric actuator corresponding thereto, said process comprising:

scanning said ink jet recording head in a first direction while simultaneously generating a plurality of uniform drive waveform signals, wherein a different plurality of uniform drive waveform signals are generated for immediately adjacent scans;

selecting for said nozzle only one or none of said plurality of uniform drive waveform signals; and applying said selected uniform drive waveform signal to the respective piezoelectric actuator corresponding to said nozzle, said plurality of uniform drive waveform signals are selected and generated at the time of said scan in the first direction so that dots with a plurality of gray scale values are generated.

2. The ink jet recording head driving method according to claim 1, characterized in that uniform drive waveform signals for discharging ink droplets with a large jet amount of ink and uniform drive waveform signals for discharging ink droplets with a small jet amount of ink are generated simultaneously.

3. The ink jet recording head driving method according to claim 1, characterized in that uniform drive waveform signals for discharging ink droplets with a large jet amount of ink and uniform drive waveform signals for discharging ink droplets with a small jet amount are alternately generated.

4. The ink jet recording head driving method claim 1, characterized in that said dot forming process is executed at least twice on a same place of said recording medium.

5. The ink jet recording head driving method according to claim 4, characterized in that during said dot forming process, a second nozzle positioned at a different place from the nozzle used during a previously executed dot forming process pass the place opposite the same place of said recording medium.

6. The ink jet recording head driving method according to claim 4, characterized in that during the dot forming process, a second nozzle positioned at the same place as the nozzle used during the previously executed dot forming process pass the place opposite the same place of said recording medium.

7. The ink jet recording head driving method according to claim 5, characterized in that the combination of uniform drive waveform signals is determined on the basis of a number of times of said dot forming process is performed and the number of times the same or a different nozzle passes the place opposite the same place of said recording medium.

8. The ink jet recording head driving method according to claim 7, characterized in that the number of times the dot forming process is performed is determined based on a high-speed printing mode that is for printing in a high-speed and a high-quality image mode.

9. An ink jet recording head driving method, the ink jet recording head having at least one nozzle and a pressure generating chamber and a piezoelectric actuator corresponding thereto, said process comprising:

performing a scan of said ink jet recording head in a first direction while simultaneously generating a plurality of uniform drive waveform signals;

selecting for said nozzle only one or none of said plurality of uniform drive waveform signals; and applying said selected uniform drive waveform signal to the piezoelectric actuator corresponding to said nozzle, said plurality of uniform drive waveform signals are selected and generated at the time of said scanning in the first direction so that dots with a plurality of gray scale values are generated, characterized in that at least one of said generated plurality of uniform drive waveform signals is different from a uniform drive waveform signal generated during an adjacent scan.

10. An ink jet recording head driving circuit for an ink jet recording head having a plurality of nozzles and a plurality of pressure generating chambers and corresponding piezoelectric actuators corresponding thereto, said ink jet recording head driving circuit in comprising:

recording means for recording uniform drive waveform information for uniform drive waveform signals;

waveform generating means for simultaneously generating a plurality of uniform drive waveform signals based on said uniform drive waveform information read from said recording means for a scan of the ink jet recording head, wherein the waveform generating means generates a different plurality of uniform drive waveform signals for adjacent scans;

control means for moving said ink jet recording head and selecting, for each of said plurality of nozzles, any one or none of the plurality of uniform drive waveform signals; and uniform drive means for applying said uniform drive waveform signal to said piezoelectric actuators by selecting none or only one of a plurality of said uniform drive waveform signals output from said uniform drive generating means generated at the time of said scanning in the first direction, so that dots with a plurality of gray scale values are generated.

11. An ink jet recording head driving circuit according to claim 10, characterized in that said waveform generating means simultaneously generates uniform drive waveform signals for discharging ink droplets with a large amount of ink and uniform drive waveforms for discharging ink droplets with a small amount of ink, in combination.

12. An ink jet recording head driving circuit according to claim 10, characterized in that said waveform generating means alternately generates a plurality of uniform drive waveform signals for discharging ink droplets with a relatively large amount of ink and uniform drive waveform signals form discharging a relatively small amount of ink at every scanning of said ink jet recording head in said first direction.

13. An ink jet recording head driving circuit according to claim 10, characterized in that said control means selects said uniform drive waveforms signals for execution at least two times in a same place of said recording medium.

14. The ink jet recording head driving circuit according to claim 13, characterized in that said control means makes nozzles, which are positioned at a different place from the nozzles used during the scanning of the ink jet recording head in the first direction, pass the place opposite the first place of said recording medium.

15. The ink jet recording head driving circuit according to claim 13, characterized in that said control means makes nozzles, which are positioned at the same place as the nozzles used for scanning of said ink jet recording head in the first direction, pass the place opposite the same place of said recording medium.

16. The ink jet recording head driving circuit according to claim 14, characterized in that said control means selects said uniform drive waveform signals on the basis of supplied data.

17. The ink jet recording head driving circuit according to claim 16, characterized in that a combination of uniform drive waveform signals is determined on the basis of a number of times said ink jet recording head scans and a number of times a same or different nozzle passes a place opposite the same place of said recording medium.

18. The ink jet recording head driving circuit according to claim 17, characterized in that the number of times said ink jet recording head scans and the number of times whereof the same or different nozzle passes the place opposite and the same place of said recording medium is determined on the basis of a high-speed printing mode for printing a high-speed and a high-quality image.

19. The ink jet recording head driving circuit according to claim 14, characterized in that said control means determines a number of times said ink jet recording head scans in the first direction and a number of times same or a different nozzle passes the place opposite the same place of said recording medium on the basis of a high-speed printing mode, determines a combination of uniform drive waveform signals selected and generates said waveform selecting data on the basis of the determined combination of said uniform drive waveform signals.

20. An ink jet recording head driving circuit for an ink jet recording head having a plurality of nozzles and a plurality of pressure generating chambers and corresponding piezoelectric actuators corresponding thereto, said ink jet recording head driving circuit in comprising:

recording means for recording uniform drive waveform information for uniform drive waveform signals;

waveform generating means for simultaneously generating a plurality of uniform drive waveform signals based on said uniform drive waveform information read from said recording means, wherein the waveform generating means generates a different plurality of uniform drive waveform signals for adjacent scans;

control means for moving said ink jet recording head and selecting, for each of said plurality of nozzles, any one or none of the plurality of uniform drive waveform signals; and uniform drive means for applying said uniform drive waveform signal to said piezoelectric actuators by selecting none or only one of a plurality of uniform drive waveform signals output from said uniform drive generating means generated at the time of said scanning in the first direction so that dots with a plurality of gray scale values are generated, characterized in that said waveform generating means generates at least one uniform drive waveform signal that is different from any of a plurality of uniform drive waveform signals generated during an adjacent scanning of said ink jet recording head in said first direction.

* * * * *